US011392052B2

(12) United States Patent
Torii et al.

(10) Patent No.: US 11,392,052 B2
(45) **Date of Patent: *Jul. 19, 2022**

(54) ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Yasuko Torii, Kanagawa (JP); Yosuke Tsurumi, Kanagawa (JP); Atsushi Sugawara, Kanagawa (JP); Yoshimasa Fujihara, Kanagawa (JP); Moegi Iguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/984,741

(22) Filed: Aug. 4, 2020

(65) Prior Publication Data

US 2021/0302855 A1 Sep. 30, 2021

(30) Foreign Application Priority Data

Mar. 19, 2020 (JP) ..... JP2020-050051

(51) Int. Cl.

| | |
|---|---|
| ***G03G 9/097*** | (2006.01) |
| ***G03G 9/08*** | (2006.01) |
| ***G03G 21/18*** | (2006.01) |
| ***G03G 9/113*** | (2006.01) |
| ***G03G 15/08*** | (2006.01) |

(52) U.S. Cl.

CPC ..... *G03G 9/09775* (2013.01); *G03G 9/0819* (2013.01); *G03G 9/0825* (2013.01); *G03G 9/09725* (2013.01); *G03G 9/1133* (2013.01); *G03G 15/0865* (2013.01); *G03G 21/1814* (2013.01)

(58) Field of Classification Search

CPC ..... G03G 9/09775; G03G 9/09725; G03G 9/0825; G03G 9/09783

USPC ..... 430/108.1, 108.7

See application file for complete search history.

(56) References Cited

U.S. PATENT DOCUMENTS

| | | | |
|---|---|---|---|
| 10,241,432 | B2 | 3/2019 | Obara et al. |
| 2010/0124433 | A1 | 5/2010 | Matsuura |

(Continued)

FOREIGN PATENT DOCUMENTS

| | | | |
|---|---|---|---|
| JP | 2010-117617 | A | 5/2010 |
| JP | 2011-232748 | A | 11/2011 |
| JP | 2018-072694 | A | 5/2018 |

*Primary Examiner* — Peter L Vajda

(74) *Attorney, Agent, or Firm* — Sughrue Mion, PLLC

(57) ABSTRACT

An electrostatic image developing toner includes a toner particle, an external additive A, and an external additive B. At least the external additive A is present on the surface of the toner particles. At least the external additive B is present on the external additive A. The number of peaks of the external additive B on the external additive A is 5 or more and 100 or less per 30 μm peripheral length of the toner particle, the peaks having a height from the surface of the toner particle of 80 nm or more and 250 nm or less.

20 Claims, 2 Drawing Sheets

(56) References Cited

U.S. PATENT DOCUMENTS

2011/0262854 A1 10/2011 Ikuta
2017/0227876 A1* 8/2017 Morooka ..... G03G 9/1075

* cited by examiner

ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2020-050051 filed Mar. 19, 2020.

BACKGROUND

(i) Technical Field

The present disclosure relates to an electrostatic image developing toner, an electrostatic image developer, a toner cartridge, a process cartridge, an image forming apparatus, and an image forming method.

(ii) Related Art

Techniques such as electrophotography for visualization of image information via electrostatic images are currently used in various fields.

In the related art, electrophotography typically involves visualizing image information through a plurality of steps including forming an electrostatic latent image on a photoreceptor or an electrostatic recording medium using various techniques, developing the electrostatic latent image (toner image) by attaching electroscopic particles, which are called toner, to the electrostatic latent image, transferring the developed image onto a surface of a recording medium, and fixing the transferred image, for example, by heating.

A toner or developer known in the art is disclosed in Japanese Unexamined Patent Application Publication No. 2018-72694, 2011-232748, or 2010-117617.

Japanese Unexamined Patent Application Publication No. 2018-72694 discloses an electrostatic image developing toner containing a toner base particle having, on a surface thereof, an external additive. The external additive includes silica particles A and silica particles B. The silica particles A have a number average primary particle size in the range of 40 to 100 nm and an average circularity in the range of 0.50 to 0.90 and is surface-modified with silicone oil. The silica particles B have a number average primary particle size of 25 nm or more, which is smaller than the number average primary particle size of the silica particles A, and is surface-modified with an alkylalkoxysilane having a structure represented by general formula (1) below or silazane.

$$R_1\text{–}Si(OR_2)_3 \qquad \text{General formula (1)}$$

[$R_1$ represents an optionally substituted linear alkyl group having 1 to 10 carbon atoms. $R_2$ represents a methyl group or an ethyl group.]

Japanese Unexamined Patent Application Publication No. 2011-232748 discloses an electrophotographic toner including at least a binder resin and a colorant. On the surface of the toner, the ratio of {average of arithmetic average roughness (Ra) in 0.5-μm square region}/{average of arithmetic average roughness (Ra) in 1-μm square region} is 0.5 or more.

Japanese Unexamined Patent Application Publication No. 2010-117617 discloses a developer including a toner containing at least a resin and a colorant. The toner includes 100 (parts by mass) of toner particles and 1.5 to 3.0 (parts by mass) of an external additive added to the toner particles and has a volume average particle size of 6.5 to 8.0 (μm) and a surface roughness Rzjis, as observed under a scanning probe microscope, of 75.3 to 236.9 (nm).

SUMMARY

Aspects of non-limiting embodiments of the present disclosure relate to an electrostatic image developing toner including a plurality of external additives. The fine-line reproducibility of the electrostatic image developing toner is higher compared to cases where the number of peaks of an external additive B on an external additive A is less than 5 or more than 100 per 30 μm peripheral length of a toner particle, the peaks having a height from the surface of the toner particle of 80 nm or more and 250 nm or less.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic image developing toner including a toner particle, an external additive A, and an external additive B. At least the external additive A is present on the surface of the toner particle. At least the external additive B is present on the external additive A. The number of peaks of the external additive B on the external additive A is 5 or more and 100 or less per 30 μm peripheral length of the toner particle, the peaks having a height from the surface of the toner particle of 80 nm or more and 250 nm or less.

BRIEF DESCRIPTION OF THE DRAWINGS

Exemplary embodiments of the present disclosure will be described in detail based on the following figures, wherein.

DETAILED DESCRIPTION

Figure 1:
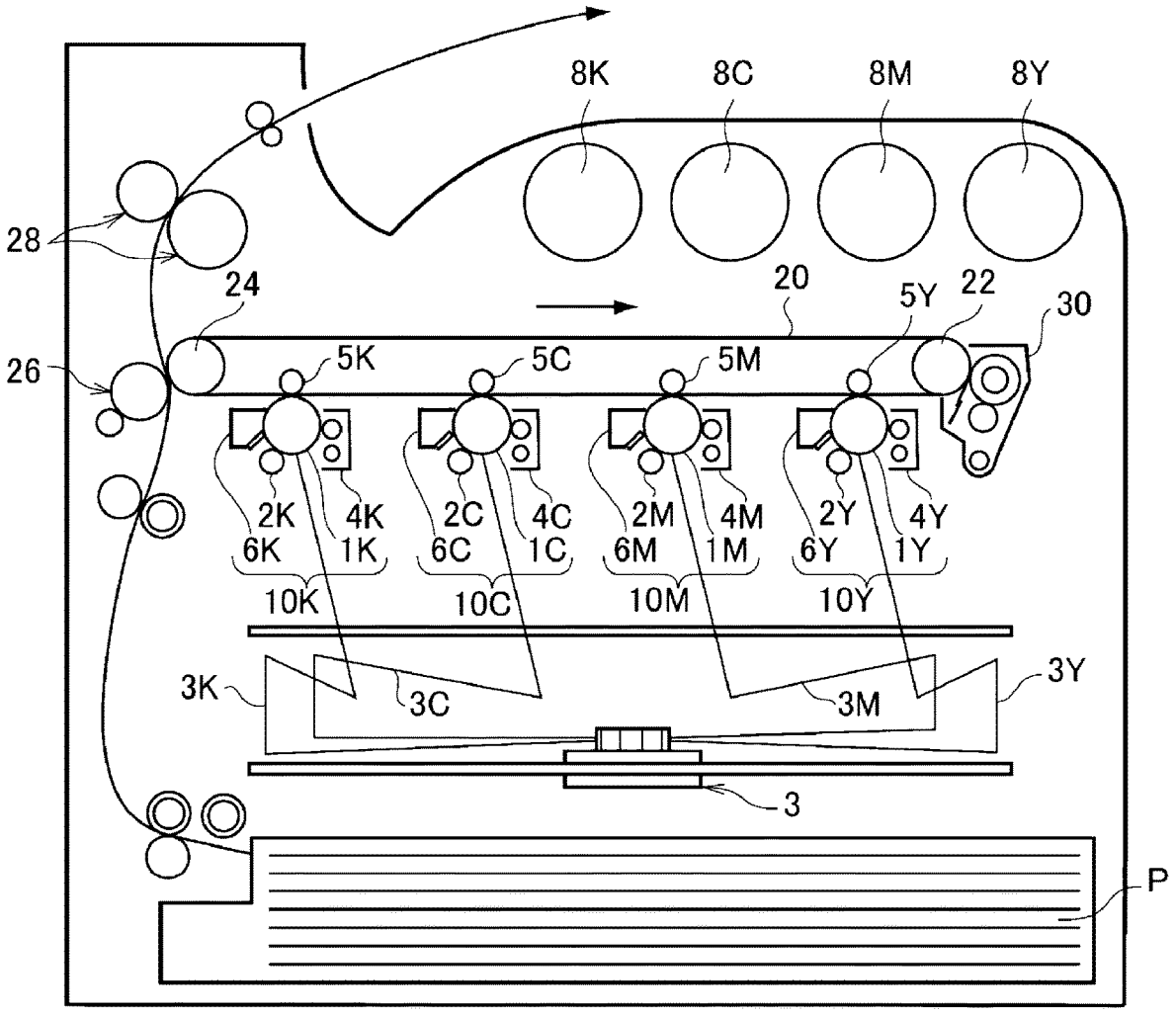
FIG. 1 illustrates a schematic configuration of an image forming apparatus according to an exemplary embodiment.

In this specification, if there are two or more substances corresponding to one component in a composition, the amount of the component in the composition refers to the total amount of the two or more substances in the composition, unless otherwise specified.

In this specification, "electrostatic image developing toner" is also referred to simply as "toner", and "electrostatic image developer" is also referred to simply as "developer".

Exemplary embodiments of the present disclosure will now be described.

Electrostatic Image Developing Toner

An electrostatic image developing toner according to an exemplary embodiment includes toner particles, an external additive A, and an external additive B. At least the external additive A is present on the surface of the toner particles. At least the external additive B is present on the external additive A. The number of peaks of the external additive B on the external additive A is 5 or more and 100 or less per 30 μm peripheral length of the toner particles, the peaks having a height from the surface of the toner particles of 80 nm or more and 250 nm or less.

In electrophotographic printing, a toner image is formed on a recording medium, and the image is fixed through thermal fusion of toner. In recent years, a wide variety of images have been demanded. For example, an image formed by stacking multiple layers of toner, such as by printing a white image on a base and printing a color image on the white image, is demanded in some cases. If thermal fixing is performed when multiple layers of toner are stacked, pressure acts in the running direction of a recording medium, and the toner is likely to scatter. The present inventors have discovered that when fine lines are printed, particularly, in a high-temperature and high-humidity environment (e.g., at 28° C. and 98% RH), a decrease in line spacing due to scattering or an increase in line spacing due to fine-line thinning may disadvantageously occur.

Due to the above configuration, the electrostatic image developing toner according to the exemplary embodiment provides an image with high fine-line reproducibility. Although not clear, the reasons for this are presumably as follows.

Presumably, due to the projections and recesses formed by the external additive B on the external additive A present on the surface of the toner particles, moderate movement is not inhibited by a fixing pressure, and a good image is provided; furthermore, by adjusting the number and size of projections formed by the external additive B on the external additive A within the above ranges, the decrease in line spacing due to scattering the and the increase in line spacing due to fine-line thinning are prevented to provide high fine-line reproducibility.

Hereinafter, the electrostatic image developing toner according to the exemplary embodiment will be described in detail.

External Additive

The toner according to the exemplary embodiment includes toner particles (also referred to as "toner base particles") and an essential external additive.

The toner according to the exemplary embodiment includes an external additive A and an external additive B. At least the external additive A is present on the surface of the toner particles. At least the external additive B is present on the external additive A. The number of peaks of the external additive B on the external additive A is 5 or more and 100 or less per 30 μm peripheral length of the toner particles, the peaks having a height from the surface of the toner particles of 80 nm or more and 200 nm or less.

The number of peaks of the external additive B on the external additive A is 5 or more and 100 or less per 30 μm peripheral length of the toner particles, the peaks having a height from the surface of the toner particles of 80 nm or more and 250 nm or less. From the viewpoint of fine-line reproducibility, the number of peaks is preferably 10 or more and 90 or less, more preferably 20 or more and 80 or less, particularly preferably 30 or more and 80 or less.

Examples of preferred methods for adjusting the number of peaks of the external additive B on the external additive A that have a height from the surface of the toner particles of 80 nm or more and 250 nm or less include, but are not limited to, the following methods. Two or more of these methods may be combined.

The external additive B is externally added after the external additive A is externally added onto the toner particles.

The coverage by the external additive A is set to be higher than the coverage by the external additive B.

An additive including particles formed by aggregation of particles having a size of 10 nm or more and 60 nm or more are used as the external additive B.

Oil-treated silica prepared by a gas phase process is used as the external additive B.

In the exemplary embodiment, peaks of the external additive B on the external additive A that have a height from the surface of the toner particles of 80 nm or more and 250 nm or less are measured by the following method.

An image of a toner to which an external additive containing silica particles is externally added is captured using a scanning electron microscope (SEM) (S-4700, manufactured by Hitachi High-Technologies Corporation) at a magnification of 30,000× and observed at an acceleration voltage of 15 kV, an emission current of 20 μA, and a WD of 15 mm. Four images per toner particle are captured. Silica particles present on the circumference of the toner particle are analyzed with image processing analysis software WinRoof (manufactured by Mitani Corporation), and the number of peaks having a height from the surface of the toner particle of 80 nm or more and 250 nm or less is counted. The number of peaks is measured for at least 200 particles, and the measured values are averaged to determine the number of peaks.

External Additive A

The electrostatic image developing toner according to the exemplary embodiment includes toner particles, an external additive A, and an external additive B, and at least the external additive A is present on the surface of the toner particles.

The external additive A is preferably formed of inorganic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

In particular, silica particles are preferred.

The external additive A is preferably formed of wet-process silica particles, more preferably sol-gel silica particles. Since the sol-gel silica particles contain a moderate amount of water, a toner to which the sol-gel silica particles are externally added readily achieves an expected charge amount upon being stirred in a developing device.

The water content of the sol-gel silica particles can be estimated on the basis of a mass reduction due to heating. The mass reduction of the sol-gel silica particles due to heating from 30° C. to 250° C. at a rate of 30° C./min is preferably 1 mass % or more and 10 mass % or less.

When the mass reduction is 1 mass % or more, the sol-gel silica particles are inhibited from flowing on the toner particle surface and are kept being very uniformly dispersed on the toner particle surface, and thus the toner readily achieves an expected charge amount upon being stirred in a developing device. From this viewpoint, the mass reduction is more preferably 2 mass % or more, still more preferably 3 mass % or more.

When the mass reduction is 10 mass % or less, charge leakage through the sol-gel silica particles is inhibited, and thus the toner readily achieves an expected charge amount upon being stirred in a developing device. From this viewpoint, the mass reduction is more preferably 9 mass % or less, still more preferably 8 mass % or less.

In the exemplary embodiment, the mass reduction due to heating of the sol-gel silica particles is determined by the following measurement method.

About 30 mg of the sol-gel silica particles are placed in a sample chamber of a thermogravimetric analyzer (manufactured by Shimadzu Corporation, model number: DTG-60AH), and the temperature is raised from 30° C. to 250° C. at a rate of 30° C./min. The mass reduction is calculated from a difference between the initial mass and the mass after heating.

The sample subjected to the thermogravimetric analyzer is formed of sol-gel silica particles used as materials for the toner or sol-gel silica particles separated from the toner. The sol-gel silica particles may be separated from the toner by any method. For example, after ultrasonic waves are applied to a dispersion of the toner in surfactant-containing water, the dispersion is subjected to high-speed centrifugation, and the resulting supernatant fluid is dried at normal temperature (23° C.±2° C.) to obtain sol-gel silica particles.

When hydrophobized sol-gel silica particles are used as an external additive, the above measurement is conducted using sol-gel silica particles after being hydrophobized as a sample.

The sol-gel silica particles are obtained, for example, as described below.

Tetraalkoxysilane is added dropwise to an alkaline catalyst solution containing an alcohol compound and aqueous ammonia to hydrolyze and condense the tetraalkoxysilane, thereby forming a suspension containing sol-gel silica particles. Subsequently, the solvent is removed from the suspension to obtain a particulate substance. The particulate substance is then dried to obtain sol-gel silica particles. The average primary particle size of the sol-gel silica particles can be controlled by adjusting the ratio of the amount of added tetraalkoxysilane to the amount of alkaline catalyst solution. The water content of the sol-gel silica particles, that is, the mass reduction due to heating from 30° C. to 250° C. at a rate of 30° C./min, can be controlled by adjusting the conditions under which the particulate substance is dried.

From the viewpoint of image unevenness suppression, the average circularity of the external additive A is preferably 0.85 or more, more preferably 0.90 or more, still more preferably 0.95 or more, particularly preferably 0.95 or more and 0.995 or less.

Non-limiting examples of the method for controlling the average circularity of the external additive A to be within the above range include adjusting the temperature at which an alkaline catalyst and tetraalkoxysilane are mixed or the reaction time in the production of the sol-gel silica particles; and adjusting the concentration of the alkaline catalyst.

The shape factors SF1 of the external additive A and the external additive B in the exemplary embodiment are determined as described below.

The toner is observed under a scanning electron microscope (SEM) (S-4700, manufactured by Hitachi, Ltd.), and an image of the toner is captured. The image is imported into an image analyzer (LUZEX III manufactured by NIRECO CORPORATION). For each of the external additive A and the external additive B, the maximum lengths and projected areas of 100 particles are determined, and the shape factors SF1 are calculated by the following formula and averaged.

$$\text{shape factor } SF1=(ML2/A)\times(\pi/4)\times 100 \qquad \text{Formula (1)}$$

In formula (1), I represents the absolute maximum length of an external additive in an image, and A represents the projected area of the external additive.

The number average particle size of the external additive A is preferably 20 nm or more and 140 nm or less.

When the number average particle size of the external additive A is 20 nm or more, the external additive A is less likely to be buried in the toner particles. From this viewpoint, the number average particle size of the external additive A is more preferably 30 nm or more, still more preferably 40 nm or more.

When the number average particle size of the external additive A is 140 nm or less, the external additive A is likely to stay on the surface of the toner particles. From this viewpoint, the number average particle size of the external additive A is more preferably 120 nm or less, still more preferably 100 nm or less.

In the exemplary embodiment, the number average particle size of an external additive is the diameter of a circle having the same area as a particle image (what is called an equivalent circle diameter) and is determined by capturing an electron microscope image of the toner to which the external additive is externally added and analyzing at least 300 external additives on the toner particles in the image. The number average particle size of the external additive is the particle size at which the cumulative number from smaller particle sizes is 50% in a number-based particle size distribution.

The external additive A may be formed of hydrophobic particles subjected to hydrophobic surface treatment. Any hydrophobizing agent may be used, and silicon-containing organic compounds are preferred. Examples of the silicon-containing organic compounds include alkoxysilane compounds, silazane compounds, and silicone oil. These may be used alone or in combination of two or more.

The hydrophobizing agent for the external additive A is preferably a silazane compound (e.g., dimethyldisilazane, trimethyldisilazane, tetramethyldisilazane, pentamethyldisilazane, or hexamethyldisilazane), particularly preferably 1,1,1,3,3,3-hexamethyldisilazane (HMDS).

The amount of the hydrophobizing agent is preferably 1 part by mass or more and 10 parts by mass or less based on 100 parts by mass of the external additive A.

Even when the external additive A is formed of hydrophobic particles subjected to hydrophobic surface treatment, the mass reduction due to heating is preferably in the above-described range, and the number average particle size is preferably in the above-described range.

In the exemplary embodiment, from the viewpoint of image unevenness suppression, the external additive A may contain a siloxane compound having a molecular weight of 200 or more and 600 or less. More preferably, the siloxane compound having a molecular weight of 200 or more and 600 or less may be attached to a part or the whole of the surface of the external additive A.

When the inorganic particles are hydrophobic inorganic particles subjected to hydrophobic surface treatment, the siloxane compound having a molecular weight of 200 or more and 600 or less may be attached to the hydrophobized surface of the inorganic particles.

The content of the external additive A based on the total mass of the toner particles is preferably 0.01 mass % or more and 10 mass % or less, more preferably 0.05 mass % or more and 8 mass % or less, still more preferably 0.1 mass % or more and 5 mass % or less.

Siloxane Compound Having Molecular Weight of 200 or More and 600 or Less

In the exemplary embodiment, from the viewpoint of image unevenness suppression, the external additive A may contain a siloxane compound having a molecular weight of 200 or more and 600 or less. More preferably, the siloxane compound having a molecular weight of 200 or more and 600 or less may be attached to a part or the whole of the surface of the external additive A.

From the viewpoint of image unevenness suppression, the siloxane compound may be a compound consisting of a siloxane bond and an alkyl group.

To relatively increase the kinematic viscosity of the siloxane compound and thereby increase the frictional force acting between the inorganic particles, the molecular weight of the siloxane compound is 200 or more, preferably 250 or more, more preferably 280 or more, still more preferably 300 or more.

To relatively increase the conductivity of the siloxane compound and thereby relatively increase the dielectric constant of the toner, the molecular weight of the siloxane compound is 600 or less, preferably 550 or less, more preferably 500 or less, still more preferably 450 or less.

The number of Si atoms in one molecule of the siloxane compound having a molecular weight of 200 or more and 600 or less is at least 2.

To relatively increase the kinematic viscosity of the siloxane compound and thereby increase the frictional force acting between the inorganic particles, the number of Si atoms in one molecule of the siloxane compound having a molecular weight of 200 or more and 600 or less is preferably 3 or more, more preferably 4 or more, still more preferably 5 or more.

To relatively increase the conductivity of the siloxane compound and thereby relatively increase the dielectric constant of the toner, the number of Si atoms in one molecule of the siloxane compound having a molecular weight of 200 or more and 600 or less is preferably 7 or less, more preferably 6 or less, still more preferably 5 or less.

From the above two viewpoints, the number of Si atoms in one molecule of the siloxane compound having a molecular weight of 200 or more and 600 or less is particularly preferably 5.

To moderately increase the frictional force acting between the inorganic particles, the kinematic viscosity at 25° C. of the siloxane compound having a molecular weight of 200 or more and 600 or less is preferably 2 $mm^2/s$ or more and 5 $mm^2/s$ or less.

In the exemplary embodiment, the kinematic viscosity ($mm^2/s$) of a siloxane is a value obtained by dividing the viscosity of the siloxane at 25° C. measured using an Ostwald viscometer, which is a capillary viscometer, by the density of the siloxane.

One example of the siloxane compound having a molecular weight of 200 or more and 600 or less is a linear siloxane compound having no branched siloxane bonds.

Examples of such a linear siloxane compound having a molecular weight of 200 or more and 600 or less include hexaalkyldisiloxanes, octaalkyltrisiloxanes, decaalkyltetrasiloxanes, dodecaalkylpentasiloxanes, tetradecaalkylhexasiloxanes, and hexadecaalkylheptasiloxanes (whose molecular weights are 200 or more and 600 or less).

Examples of the alkyl group included in these linear siloxane compounds include linear alkyl groups having 1 to 10 carbon atoms (preferably 1 to 6 carbon atoms, more preferably 1 to 3 carbon atoms, still more preferably 1 or 2 carbon atoms), branched alkyl groups having 3 to 10 carbon atoms (preferably 3 to 6 carbon atoms, more preferably 3 or 4 carbon atoms), and cycloalkyl groups having 3 to 10 carbon atoms (preferably having 3 to 6 carbon atoms, more preferably 3 or 4 carbon atoms). Of these, alkyl groups having 1 to 3 carbon atoms are preferred, at least one of a methyl group and an ethyl group is preferred, and a methyl group is more preferred. Two or more alkyl groups in one molecule of the linear siloxane compound may be the same as or different from each other.

Specific examples of the linear siloxane compound having a molecular weight of 200 or more and 600 or less include octamethyltrisiloxane, decamethyltetrasiloxane, dodecamethylpentasiloxane, tetradecamethylhexasiloxane, and hexadecamethylheptasiloxane.

One example of the siloxane compound having a molecular weight of 200 or more and 600 or less is a branched siloxane having a branched siloxane bond.

Examples of such a branched siloxane compound having a molecular weight of 200 or more and 600 or less include branched siloxane compounds such as 1,1,1,3,5,5,5-heptaalkyl-3-(trialkylsiloxy)trisiloxanes, tetrakis(trialkylsiloxy)silanes, and 1,1,1,3,5,5,7,7,7-nonaalkyl-3-(trialkylsiloxy)tetrasiloxanes (whose molecular weights are 200 or more and 600 or less).

Examples of the alkyl group included in these branched siloxane compounds include linear alkyl groups having 1 to 10 carbon atoms (preferably 1 to 6 carbon atoms, more preferably 1 to 3 carbon atoms, still more preferably 1 or 2 carbon atoms), branched alkyl groups having 3 to 10 carbon atoms (preferably 3 to 6 carbon atoms, more preferably 3 or 4 carbon atoms), and cycloalkyl groups having 3 to 10 carbon atoms (preferably having 3 to 6 carbon atoms, more preferably 3 or 4 carbon atoms). Of these, alkyl groups having 1 to 3 carbon atoms are preferred, at least one of a methyl group and an ethyl group is preferred, and a methyl group is more preferred. Two or more alkyl groups in one molecule of the branched siloxane compound may be the same as or different from each other.

Specific examples of the branched siloxane compound having a molecular weight of 200 or more and 600 or less include methyltris(trimethylsiloxy)silane (molecular formula: $C_{10}H_{30}O_3Si_4$), tetrakis(trimethylsiloxy)silane (molecular formula: $C_{12}H_{36}O_4Si_5$), and 1,1,1,3,5,5,7,7,7-nonamethyl-3-(trimethylsiloxy)tetrasiloxane (molecular formula: $C_{12}H_{36}O_4Si_5$).

One example of the siloxane compound having a molecular weight of 200 or more and 600 or less is a cyclic siloxane compound having a cyclic structure consisting of siloxane bonds.

Examples of such a cyclic siloxane compound having a molecular weight of 200 or more and 600 or less include hexaalkylcyclotrisiloxanes, octaalkylcyclotetrasiloxanes, decaalkylcyclopentasiloxanes, dodecaalkylcyclohexasiloxanes, tetradecaalkylcycloheptasiloxanes, and hexadecaalkylcyclooctasiloxanes (whose molecular weights are 200 or more and 600 or less).

Examples of the alkyl group included in these cyclic siloxane compounds include linear alkyl groups having 1 to 10 carbon atoms (preferably 1 to 6 carbon atoms, more preferably 1 to 3 carbon atoms, still more preferably 1 or 2 carbon atoms), branched alkyl groups having 3 to 10 carbon atoms (preferably 3 to 6 carbon atoms, more preferably 3 or 4 carbon atoms), and cycloalkyl groups having 3 to 10 carbon atoms (preferably having 3 to 6 carbon atoms, more preferably 3 or 4 carbon atoms). Of these, alkyl groups having 1 to 3 carbon atoms are preferred, at least one of a methyl group and an ethyl group is preferred, and a methyl group is more preferred. Two or more alkyl groups in one molecule of the low-molecular-weight cyclic siloxane may be the same as or different from each other.

Specific examples of the cyclic siloxane compound having a molecular weight of 200 or more and 600 or less include hexamethylcyclotrisiloxane, octamethylcyclotetrasiloxane, decamethylcyclopentasiloxane, dodecamethylcyclohexasiloxane, tetradecamethylcycloheptasiloxane, and hexadecamethylcyclooctasiloxane.

For the toner including a siloxane compound to readily achieve an expected charge amount upon being stirred in a developing device, the siloxane compound having a molecular weight of 200 or more and 600 or less is preferably at least one selected from the group consisting of linear siloxane compounds and branched siloxane compounds, more preferably a branched siloxane compound, still more preferably a siloxane compound having a tetrakis structure. The siloxane having a tetrakis structure refers to a siloxane having in its molecule at least one structure represented by the following formula (i.e., tetrakissiloxysilane structure).

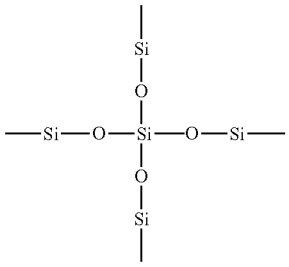

Examples of the siloxane compound having a tetrakis structure and a molecular weight of 200 or more and 600 or less include tetrakis(trialkylsiloxy)silanes, and examples of the alkyl group in the siloxane compound include alkyl groups having 1 to 10 carbon atoms (preferably 1 to 6 carbon atoms, more preferably 1 to 3 carbon atoms, still more preferably 1 or 2 carbon atoms), branched alkyl groups having 3 to 10 carbon atoms (preferably 3 to 6 carbon atoms, more preferably 3 or 4 carbon atoms), and cycloalkyl groups having 3 to 10 carbon atoms (preferably having 3 to 6 carbon atoms, more preferably 3 or 4 carbon atoms). Of these, alkyl groups having 1 to 3 carbon atoms are preferred, at least one of a methyl group and an ethyl group is preferred, and a methyl group is more preferred. The alkyl groups in one molecule of the siloxane compound having a tetrakis structure may be the same as or different from each other.

For the toner including a siloxane compound to readily achieve an expected charge amount upon being stirred in a developing device, the siloxane compound having a molecular weight of 200 or more and 600 or less is particularly preferably tetrakis(trimethylsiloxy)silane.

The total content of the siloxane compound having a molecular weight of 200 or more and 600 or less included in the toner is measured by a headspace method with a gas chromatograph mass spectrometer (manufactured by Shimadzu Corporation, GCMS-QP2020) and a nonpolar column (manufactured by Restek, Rtx-1, 10157, thickness: 1.00 μm, length: 60 m, inner diameter: 0.32 mm). Specifically, the measurement is performed by the following method.

The toner is weighed into a vial, and the vial is sealed with a cap and heated to 190° C. over 3 minutes. Subsequently, the volatilized component in the vial is introduced into the column, and the siloxane compound having a molecular weight of 200 or more and 600 or less is detected under the following conditions.

Carrier gas type: helium

Carrier gas pressure: 120 kPa (constant pressure)

Oven temperature: 40° C. (5 minutes)→(15° C./min) →250° C. (6 minutes) (25 minutes in total)

Ion source temperature: 260° C.

Interface temperature: 260° C.

A calibration curve is constructed using standard solutions prepared by diluting a reference material (tetrakis(trimethylsiloxy)silane 1) with ethanol and having different concentrations. The amount of the siloxane compound having a molecular weight of 200 or more and 600 or less is determined on the basis of a peak area of the siloxane compound that appears in a chromatograph of a sample and the calibration curve of the reference material. When there are two or more peaks attributed to the siloxane compound having a molecular weight of 200 or more and 600 or less in the chromatograph of the sample, the total amount of the siloxane compound is determined on the basis of the total area of the peak areas and the calibration curve of the reference material. Furthermore, the total content (ppm) of the siloxane compound having a molecular weight of 200 or more and 600 or less with respect to the total amount of the toner is calculated.

To increase the frictional force acting between the inorganic particles, the total content of the siloxane compound having a molecular weight of 200 or more and 600 or less in the external additive A, based on the total mass of the external additive A, is preferably 1 ppm or more, more preferably 5 ppm or more, still more preferably 10 ppm or more, even more preferably 15 ppm or more, yet even more preferably 20 ppm or more.

To prevent a decrease in dielectric constant of the toner, the total content of the siloxane compound having a molecular weight of 200 or more and 600 or less in the external additive A, based on the total mass of the external additive A, is preferably 1000 ppm or less, more preferably 500 ppm or less, still more preferably 200 ppm or less, even more preferably 100 ppm or less, yet even more preferably 50 ppm or less.

The above mass proportion is a value of {total content of siloxane compound having molecular weight of 200 or more and 600 or less in external additive A/total mass of external additive A in toner} expressed in parts per million.

When the external additive A is formed of hydrophobized inorganic particles, the mass of the external additive A refers to the mass of the external additive A after being hydrophobized, that is, the mass inclusive of the mass of components derived from the hydrophobizing agent.

The siloxane compound having a molecular weight of 200 or more and 600 or less can be incorporated into the external additive A, for example, by being externally added to the toner particles or by being used as a surface-treating agent for the external additive A (particularly, the sol-gel silica particles).

External Additive B

The electrostatic image developing toner according to the exemplary embodiment includes toner particles, an external additive A, and an external additive B. At least the external additive A is present on the surface of the toner particles. At least the external additive B is present on the external additive A. The number of peaks of the external additive B on the external additive A is 5 or more and 100 or less per 30 μm peripheral length of the toner particles, the peaks having a height from the surface of the toner particles of 80 nm or more and 250 nm or less.

The external additive B may be an aggregate of two or more particles, and the coverage by the external additive B may be 3 area % or more based on the total surface area of the toner particles.

In the electrostatic image developing toner according to the exemplary embodiment, from the viewpoint of fine-line reproducibility, preferably 70 number % or more, more preferably 80 number % or more, particularly preferably 80 number % or more and 100 number % or less of the external additive B is constituted by secondary particles (aggregated particles).

The whole external additive B included in the toner may be, but not necessarily, present on the external additive A. From the viewpoint of image unevenness suppression, 30 number % or more of the external additive B included in the toner is preferably present on the external additive A, 50 number % or more of the external additive B included in the toner is more preferably present on the external additive A, and 70 number % or more of the external additive B included in the toner is particularly preferably present on the external additive A.

The external additive B may be an aggregate of two or more particles. That is, the external additive B may be an aggregated particle (also referred to as a "secondary particle") formed by aggregation of two or more primary particles.

The external additive B is preferably an aggregate of 2 to 10 particles, more preferably an aggregate of 2 or 8 particles, particularly preferably an aggregate of 2 to 6 particles.

The external additive B is preferably formed of inorganic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Of these, silica particles, titania particles, or silica titania composite particles are preferred, and silica particles are particularly preferred.

Furthermore, from the viewpoint of fine-line reproducibility, the external additive B is preferably formed of particles prepared by a gas phase process (gas-phase-process particles), more preferably silica particles prepared by a gas phase process (gas-phase-process silica particles).

Furthermore, from the viewpoint of fine-line reproducibility, the external additive A may be formed of wet-process silica particles, and the external additive B may be formed of gas-phase-process silica particles.

In the electrostatic image developing toner according to the exemplary embodiment, from the viewpoint of fine-line reproducibility, the coverage by the external additive B based on the total surface area of the toner particles is preferably 3 area % or more, more preferably 5 area % or more and 80 area % or less, still more preferably 5 area % or more and 60 area % or less, particularly preferably 10 area % or more and 50 area % or less.

In the electrostatic image developing toner according to the exemplary embodiment, from the viewpoint of fine-line reproducibility, the coverage by the external additive A based on the total surface area of the toner particles is preferably 5 area % or more, more preferably 20 area % or more and 90 area % or less, particularly preferably 30 area % or more and 80 area % or less.

Furthermore, in the electrostatic image developing toner according to the exemplary embodiment, from the viewpoint of fine-line reproducibility, the coverage by an external additive including the external additive A and the external additive B based on the total surface area of the toner particles is preferably 20 area % or more, more preferably 30 area % or more, particularly preferably 40 area % or more and 100 area % or less.

In the exemplary embodiment, the coverage by each external additive based on the total surface area of the toner particles is measured by the following measurement method.

The toner is observed under a scanning electron microscope (SEM) (S-4700, manufactured by Hitachi, Ltd.), and an image of the toner is captured. Using the captured image, the total surface area of the toner particles, the area of a region where the external additive A is attached, and the area of a region where the external additive B is attached are measured.

Next, the coverage by each external additive is calculated according to the following formulae.

$$\text{external additive } B \text{ coverage}[\%] = (\text{area of region where external additive } B \text{ is attached})/(\text{total surface area of toner particles}) \times 100 \quad \text{Formula (2)}$$

$$\text{external additive } A \text{ coverage}[\%] = (\text{area of region where external additive } A \text{ is attached})/(\text{total surface area of toner particles}) \times 100 \quad \text{Formula (3)}$$

From the viewpoint of fine-line reproducibility, the average circularity of the external additive B is preferably 0.5 or more and 0.95 or less, more preferably 0.5 or more and 0.85 or less, particularly preferably 0.6 or more and 0.85 or less.

From the viewpoint of fine-line reproducibility, the average primary particle size of the external additive B is preferably 5 nm or more and 150 nm or less, more preferably 10 nm or more and 130 nm or less, particularly preferably 20 nm or more and 100 nm or less.

From the viewpoint of fine-line reproducibility, the number average particle size (secondary particle size) of the external additive B is preferably 50 nm or more and 400 nm or less, more preferably 100 nm or more and 300 nm or less, particularly preferably 120 nm or more and 200 nm or less.

From the viewpoint of fine-line reproducibility, the content of the external additive B based on the total mass of the toner particles is preferably 0.01 mass % or more and 10 mass % or less, more preferably 0.05 mass % or more and 5 mass % or less, still more preferably 0.1 mass % or more and 3 mass % or less.

In the exemplary embodiment, from the viewpoint of fine-line reproducibility, the value of CB/CA, where CA is a coverage by the external additive A based on the total surface area of the toner particles, and CB is a coverage by the external additive B based on the total surface area of the toner particles, is preferably 0.03 or more and 2.0 or less, more preferably 0.5 or more and 1.5 or less, particularly preferably 0.10 or more and 1.2 or less.

Furthermore, in the exemplary embodiment, from the viewpoint of fine-line reproducibility, the number average particle size of the external additive B is preferably larger than the number average particle size of the external additive A, the value of number average particle size of external additive B—number average particle size of external additive A is more preferably 10 nm or more and 200 nm or less, and the value of number average particle size of external additive B—number average particle size of external additive A is particularly preferably 30 nm or more and 150 nm or less.

From the viewpoint of fine-line reproducibility, the ratio of the number average particle size $P^B$ of the secondary particles of the external additive B to the number average particle size $P^A$ of the external additive A ($P^B/P^A$) is preferably more than 0.5 and 30 or less, more preferably 0.5 or more and 20 or less, still more preferably 1.0 or more and 10 or less, particularly preferably 1.0 or more and 5 or less.

Particles other than the external additive A and the external additive B may be included as external additives.

The number average particle sizes of the particles used as external additives other than the external additive A and the external additive B are each independently preferably 10 nm or more and 400 nm or less, more preferably 20 nm or more and 200 nm or less, particularly preferably 40 nm or more and 100 nm or less.

The external additives other than the external additive A and the external additive B are not particularly limited and may be formed of inorganic particles or organic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and $SrTiO_3$.

Examples of the organic particles include resin particles (particles of resins such as silicone, polystyrene, polymethyl methacrylate (PMMA), and melamine resins) and cleaning active agents (e.g., particles of higher fatty acid metal salts such as zinc stearate, and fluoropolymer particles).

From the viewpoint of fine-line reproducibility, the content of the external additives other than the external additive A and the external additive B is preferably smaller than the content of the external additive A and the content of the external additive B.

Toner Particles

The toner particles, for example, contain a binder resin, a release agent, and optionally a colorant and other additives. Preferably, the toner particles contain a binder resin, a colorant, and a release agent.

Binder Resin

Examples of the binder resin include vinyl resins made of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene); and vinyl resins made of copolymers of two or more of these monomers.

Other examples of the binder resin include non-vinyl resins such as epoxy resins, polyester resins, polyurethane resins, polyamide resins, cellulose resins, polyether resins, and modified rosins; mixtures of these non-vinyl resins and the above vinyl resins; and graft polymers obtained by polymerization of vinyl monomers in the presence of these non-vinyl resins.

In particular, styrene acrylic resins and polyester resins are suitable for use, and polyester resins are more suitable for use.

These binder resins may be used alone or in combination of two or more.

The binder resin may be an amorphous (non-crystalline) resin or a crystalline resin.

From the viewpoint of the image intensity of fine lines, the binder resin preferably includes a crystalline resin, more preferably includes an amorphous resin and a crystalline resin.

The content of the crystalline resin based on the total mass of the binder resin is preferably 2 mass % or more and 30 mass % or less, more preferably 5 mass % or more and 20 mass % or less.

"Crystalline" in the context of a resin means that the resin shows a distinct endothermic peak, rather than a stepwise change in the amount of heat absorbed, in differential scanning calorimetry (DSC). Specifically, it means that the half-width of the endothermic peak measured at a heating rate of 10° C./min is within 15° C.

"Amorphous" in the context of a resin means that the half-width exceeds 15° C., that a stepwise change in the amount of heat absorbed is shown, or that no distinct endothermic peak is observed.

The polyester resin may be, for example, a known polyester resin.

The polyester resin may be a combination of an amorphous polyester resin and a crystalline polyester resin. The content of the crystalline polyester resin based on the total mass of the binder resin is preferably 2 mass % or more and 30 mass % or less, more preferably 5 mass % or more and 20 mass % or less.

Amorphous Polyester Resin

Examples of the amorphous polyester resin include polycondensates of polycarboxylic acids with polyhydric alcohols. The amorphous polyester resin for use may be a commercially available product or may be synthesized.

Examples of the polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, and lower (e.g., C1 to C5) alkyl esters thereof. Of these, aromatic dicarboxylic acids are preferred, for example.

The polycarboxylic acid may be a combination of a dicarboxylic acid with a trivalent or higher valent carboxylic acid having a crosslinked or branched structure. Examples of the trivalent or higher valent carboxylic acid include trimellitic acid, pyromellitic acid, anhydrides thereof, and lower (e.g., C1 to C5) alkyl esters thereof.

These polycarboxylic acids may be used alone or in combination of two or more.

Examples of the polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these, aromatic diols and alicyclic diols are preferred, for example, and aromatic diols are more preferred.

The polyhydric alcohol may be a combination of a diol with a trivalent or higher valent polyhydric alcohol having a crosslinked or branched structure. Examples of the trivalent or higher valent polyhydric alcohol include glycerol, trimethylolpropane, and pentaerythritol.

These polyhydric alcohols may be used alone or in combination of two or more.

The glass transition temperature (Tg) of the amorphous polyester resin is preferably 50° C. or higher and 80° C. or lower, more preferably 50° C. or higher and 65° C. or lower.

The glass transition temperature is determined from a DSC curve obtained by differential scanning calorimetry (DSC). More specifically, the glass transition temperature is determined in accordance with "Extrapolation Glass Transition Onset Temperature" described in Determination of Glass Transition Temperature in JIS K7121-1987 "Testing Methods for Transition Temperatures of Plastics".

The weight average molecular weight (Mw) of the amorphous polyester resin is preferably 5,000 or more and 1,000,000 or less, more preferably 7,000 or more and 500,000 or less.

The number average molecular weight (Mn) of the amorphous polyester resin is preferably 2,000 or more and 100,000 or less.

The molecular weight distribution Mw/Mn of the amorphous polyester resin is preferably 1.5 or more and 100 or less, more preferably 2 or more and 60 or less.

The weight average molecular weight and the number average molecular weight are determined by gel permeation chromatography (GPC). The molecular weight determination by GPC is performed using an HLC-8120GPC system manufactured by Tosoh Corporation as a measurement apparatus, a TSKgel SuperHM-M column (15 cm) manufactured by Tosoh Corporation, and a THF solvent. The weight average molecular weight and the number average molecular weight are determined using a molecular weight calibration curve prepared from the measurement results relative to monodisperse polystyrene standards.

The amorphous polyester resin is produced by a known process. Specifically, the amorphous resin is produced, for example, by performing a polymerization reaction at a temperature of 180° C. to 230° C., optionally while removing water and alcohol produced during condensation by reducing the pressure in the reaction system.

If any starting monomer is insoluble or incompatible at the reaction temperature, it may be dissolved by adding a high-boiling solvent as a solubilizer. In this case, the polycondensation reaction is performed while distilling off the solubilizer. When a poorly compatible monomer is present, the poorly compatible monomer may be condensed with an acid or alcohol to be polycondensed with the monomer before being polycondensed with the major components.

Crystalline Polyester Resin

Examples of the crystalline polyester resin include polycondensates of polycarboxylic acids with polyhydric alcohols. The crystalline polyester resin for use may be a commercially available product or may be synthesized.

To easily form a crystalline structure, the crystalline polyester resin may be a polycondensate prepared from linear aliphatic polymerizable monomers rather than from aromatic polymerizable monomers.

Examples of the polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, and naphthalene-2,6-dicarboxylic acid), anhydrides thereof, and lower (e.g., C1 to C5) alkyl esters thereof.

The polycarboxylic acid may be a combination of a dicarboxylic acid with a trivalent or higher valent carboxylic acid having a cross-linked or branched structure. Examples of tricarboxylic acids include aromatic carboxylic acids (e.g., 1,2,3-benzenetricarboxylic acid, 1,2,4-benzenetricarboxylic acid, and 1,2,4-naphthalenetricarboxylic acid), anhydrides thereof, and lower (e.g., C1 to C5) alkyl esters thereof.

The polycarboxylic acid may be a combination of such a dicarboxylic acid with a dicarboxylic acid having a sulfonic group or a dicarboxylic acid having an ethylenic double bond.

These polycarboxylic acids may be used alone or in combination of two or more.

Examples of the polyhydric alcohols include aliphatic diols (e.g., linear aliphatic diols having 7 to 20 main-chain carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these, 1,8-octanediol, 1,9-nonanediol, and 1,10-decanediol are preferred.

The polyhydric alcohol may be a combination of a diol with a trivalent or higher valent alcohol having a cross-linked or branched structure. Examples of the trivalent or higher valent alcohol include glycerol, trimethylolethane, trimethylolpropane, and pentaerythritol.

These polyhydric alcohols may be used alone or in combination of two or more.

The amount of aliphatic diol in the polyhydric alcohol may be 80 mol % or more and is preferably 90 mol % or more.

The melting temperature of the crystalline polyester resin is preferably 50° C. or higher and 100° C. or lower, more preferably 55° C. or higher and 90° C. or lower, still more preferably 60° C. or higher and 85° C. or lower.

The melting temperature is determined from a DSC curve obtained by differential scanning calorimetry (DSC) in accordance with "Melting Peak Temperature" described in Determination of Melting Temperature of JIS K7121-1987 "Testing Methods for Transition Temperatures of Plastics".

The weight average molecular weight (Mw) of the crystalline polyester resin is preferably 6,000 or more and 35,000 or less.

The crystalline polyester resin is produced, for example, by a known method, as with the amorphous polyester resin.

From the viewpoint of scratch resistance of images, the weight average molecular weight (Mw) of the binder resin is preferably 5,000 or more and 1,000,000 or less, more preferably 7,000 or more and 500,000 or less, particularly preferably 25,000 or more and 60,000 or less. The number average molecular weight (Mn) of the binder resin is preferably 2,000 or more and 100,000 or less. The molecular weight distribution Mw/Mn of the binder resin is preferably 1.5 or more and 100 or less, more preferably 2 or more and 60 or less.

The weight average molecular weight and the number average molecular weight of the binder resin are determined by gel permeation chromatography (GPC). The molecular weight determination by GPC is performed using an HLC-8120GPC system manufactured by Tosoh Corporation as a measurement apparatus, a TSKgel SuperHM-M column (15 cm) manufactured by Tosoh Corporation, and a tetrahydrofuran (THF) solvent. The weight average molecular weight and the number average molecular weight are determined using a molecular weight calibration curve prepared from the measurement results relative to monodisperse polystyrene standards.

The content of the binder resin based on the total mass of the toner particles is preferably 40 mass % or more and 95 mass % or less, more preferably 50 mass % or more and 90 mass % or less, still more preferably 60 mass % or more and 85 mass % or less.

Release Agent

Examples of the release agent include hydrocarbon waxes; natural waxes such as carnauba wax, rice wax, and Candelilla wax; synthetic, mineral, and petroleum waxes such as montan wax; and ester waxes such as fatty acid esters and montanic acid esters, but are not limited thereto.

The melting temperature of the release agent is preferably 50° C. or higher and 110° C. or lower, more preferably 60° C. or higher and 100° C. or lower.

The melting temperature is determined from a DSC curve obtained by differential scanning calorimetry (DSC) in accordance with "Melting Peak Temperature" described in Determination of Melting Temperature of JIS K7121-1987 "Testing Methods for Transition Temperatures of Plastics".

From the viewpoint of fine-line reproducibility, the domain size of the release agent in the toner particles is preferably 200 nm or more and 2,000 nm or less, more preferably 400 nm or more and 1,500 nm or less, still more preferably 500 nm or more and 1,300 nm or less, particularly preferably 600 nm or more and 1,200 nm or less.

The domain size (domain average size) of the release agent is a value determined by the following method.

The toner particles (or the toner) are mixed and embedded in an epoxy resin, and the epoxy resin is cured. The resulting cured resin is sliced with an ultramicrotome (Ultracut UCT manufactured by Leica Microsystems) to prepare a sample section having a thickness of 80 nm or more and 130 nm or less. The sample section is then stained with ruthenium tetroxide in a desiccator at 30° C. for 3 hours. An SEM image of the stained sample section is captured under a super-resolution field-emission scanning electron microscope (FE-SEM: S-4800 manufactured by Hitachi High-Technologies Corporation).

In sections of the toner particles, colorant domains are distinguishable by their size because they are smaller than release agent domains. Colorant domains are also distinguishable by the depth of the color of stained release agent domains.

In the SEM image, 30 toner particle sections having a maximum length larger than or equal to 85% of the volume average particle size of the toner particles are selected, and a total of 100 stained release agent domains are observed. The maximum length of each domain is measured as the length of the major axis of the domain, and the arithmetic average of the measured maximum lengths is calculated to determine the average size in the ° C. plane (domain size).

The content of the release agent based on the total mass of the toner particles is preferably 1 mass % or more and 20 mass % or less, more preferably 5 mass % or more and 15 mass % or less.

Colorant

Examples of the colorant include various pigments such as carbon black, chromium yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination of two or more.

Optionally, the colorant may be a surface-treated colorant or may be used in combination with a dispersant. The colorant may be a combination of different colorants.

For example, the content of the colorant based on the total mass of the toner particles is preferably 1 mass % or more and 30 mass % or less, more preferably 3 mass % or more and 15 mass % or less.

Other Additives

Examples of other additives include known additives such as magnetic materials, charge control agents, and inorganic powders. These additives are contained as internal additives in the toner particles.

Properties of Toner Particles

The toner particles may be toner particles having a single-layer structure or toner particles having, what is called, a core-shell structure composed of a core (core particle) and a coating layer (shell layer) covering the core (core-shell particles). The toner particles having a core-shell structure is composed of, for example, a core and a coating layer, the core containing a binder resin and optionally a colorant, a release agent, and the like, the coating layer containing a binder resin.

In particular, the toner particles may be core-shell particles from the viewpoint of fine-line reproducibility.

The volume average particle size ($D_{50v}$) of the toner particles is preferably 2 μm or more and 10 μm or less, more preferably 4 μm or more and 8 μm or less.

The volume average particle size of the toner particles is measured using a COULTER MULTISIZER II (manufactured by Beckman Coulter, Inc.) and ISOTON-II electrolyte solution (manufactured by Beckman Coulter, Inc.).

In the measurement, 0.5 mg to 50 mg of a test sample is added to 2 mL of a 5 mass % aqueous solution of a surfactant (e.g., sodium alkylbenzene sulfonate) serving as a dispersant. The resulting solution is added to 100 mL to 150 mL of the electrolyte solution.

The electrolyte solution containing the suspended sample is dispersed with a sonicator for one minute, and the particle size of particles having particle sizes in the range of from 2 μm to 60 μm is measured with a COULTER MULTISIZER II using an aperture with an aperture size of 100 μm. The number of sampled particles is 50,000.

A volume-based cumulative distribution of the measured particle sizes is drawn from smaller particle sizes. The volume average particle size $D_{50v}$ is defined as the particle size at a cumulative value of 50%.

In the exemplary embodiment, the average circularity of the toner particles is not particularly limited, but for improved cleaning of the toner off the image carrier, it is preferably 0.91 or more and 0.98 or less, more preferably 0.94 or more and 0.98 or less, still more preferably 0.95 or more and 0.97 or less.

In the exemplary embodiment, the circularity of a toner particle is expressed as (peripheral length of circle having the same area as projected particle image)/(peripheral length of projected particle image), and the average circularity of the toner particles is the circularity at a cumulative value of 50% from smaller circularities in a circularity distribution. The average circularity of the toner particles is determined by analyzing at least 3,000 toner particles with a flow particle image analyzer.

For example, when the toner particles are produced by aggregation and coalescence, the average circularity of the toner particles can be controlled by adjusting the rate of stirring a dispersion, the temperature of the dispersion, or the retention time in a fusion and coalescence step.

Method for Producing Toner

Next, a method for producing the toner according to the exemplary embodiment will be described.

The toner according to the exemplary embodiment is obtained by producing toner particles and then externally adding an external additive to the toner particles.

The toner particles may be produced by a dry process (e.g., kneading pulverization) or a wet process (e.g., aggregation and coalescence, suspension polymerization, or dissolution suspension). Not only these processes but any known process may be employed. Of these, aggregation and coalescence may be used to obtain the toner particles.

In the kneading pulverization, toner-forming materials including a binder resin, a release agent, and optionally a colorant are kneaded to obtain a kneaded mixture, and the kneaded mixture is then pulverized to thereby suitably prepare the toner particles.

Specifically, for example, when the toner particles are produced by aggregation and coalescence, they are produced by the following steps: a step (a resin-particle dispersion preparing step) of preparing a resin-particle dispersion in which resin particles serving as a binder resin are dispersed; a step (an aggregated particle forming step) of aggregating the resin particles (optionally, other particles) in the resin-particle dispersion (optionally, a dispersion mixture with another particle dispersion) to form aggregated particles; and a step (a fusion and coalescence step) of heating the aggregated-particle dispersion, in which the aggregated particles are dispersed, to fuse and coalesce the aggregated particles, thereby forming toner particles.

The steps will be described below in detail.

Although a method for producing toner particles containing a colorant and a release agent will be described below, the colorant and the release agent are optional. It should be understood that additives other than the colorant and the release agent may also be used.

Resin-Particle Dispersion Preparing Step

A resin-particle dispersion in which resin particles serving as a binder resin are dispersed as well as, for example, a colorant-particle dispersion in which colorant particles are dispersed and a release-agent-particle dispersion in which release agent particles are dispersed are prepared.

The resin-particle dispersion is prepared, for example, by dispersing resin particles in a dispersion medium with a surfactant.

The dispersion media used to prepare the resin-particle dispersion may be, for example, an aqueous medium.

Examples of the aqueous medium include water, such as distilled water and ion-exchange water, and alcohols. These aqueous media may be used alone or in combination of two or more.

Examples of the surfactant include anionic surfactants such as sulfate ester salts, sulfonate salts, phosphate esters, and soaps; cationic surfactants such as amine salts and quaternary ammonium salts; and nonionic surfactants such as polyethylene glycol, alkylphenol-ethylene oxide adducts, and polyhydric alcohols. Of these, anionic surfactants and cationic surfactants are particularly preferred. Nonionic surfactants may be used in combination with an anionic surfactant or a cationic surfactant.

These surfactants may be used alone or in combination of two or more.

In preparing the resin-particle dispersion, the resin particles may be dispersed in a dispersion medium by any commonly-used dispersion technique, for example, a rotary shear homogenizer or a media mill such as a ball mill, a sand mill, or a Dyno-Mill. Depending on the type of resin particles, the resin particles may be dispersed in the dispersion medium by phase-inversion emulsification. Phase-inversion emulsification is a process involving dissolving a resin of interest in a hydrophobic organic solvent capable of dissolving the resin, neutralizing the organic continuous phase (O-phase) by adding a base thereto, and then adding an aqueous medium (W-phase) to cause phase inversion from W/O to O/W, thereby dispersing the resin in the form of particles in the aqueous medium.

The volume average particle size of the resin particles dispersed in the resin-particle dispersion is, for example, preferably 0.01 μm or more and 1 μm or less, more preferably 0.08 μm or more and 0.8 μm or less, still more preferably 0.1 μm or more and 0.6 μm or less.

The volume average particle size of the resin particles is determined as follows. A particle size distribution is obtained using a laser diffraction particle size distribution analyzer (e.g., LA-700 manufactured by Horiba, Ltd.) and is divided into particle size classes (channels). A cumulative volume distribution is drawn from smaller particle sizes. The volume average particle size D50v is measured as the particle size at which the cumulative volume is 50% of all particles. The volume average particle sizes of particles in other dispersions are determined in the same manner.

The content of the resin particles in the resin-particle dispersion is preferably 5 mass % or more and 50 mass % or less, more preferably 10 mass % or more and 40 mass % or less.

The colorant-particle dispersion and the release-agent-particle dispersion are prepared in the same manner as the resin-particle dispersion. That is, the volume average particle size of particles, the dispersion medium, the dispersion technique, and the content of the particles for the resin-particle dispersion are also applied to colorant particles dispersed in the colorant-particle dispersion and release agent particles dispersed in the release-agent-particle dispersion.

Aggregate Particle Forming Step

Next, the resin-particle dispersion, the colorant-particle dispersion, and the release-agent-particle dispersion are mixed together.

The resin particles, the colorant particles, and the release agent particles are then allowed to undergo heteroaggregation in the mixed dispersion to form aggregated particles including the resin particles, the colorant particles, and the release agent particles. The aggregated particles have a particle size close to that of the desired toner particles.

Specifically, the aggregated particles are formed, for example, by adding an aggregating agent to the mixed dispersion while adjusting the mixed dispersion to an acidic pH (e.g., a pH of 2 to 5), optionally adding a dispersion stabilizer, and then heating the mixed dispersion to aggregate the particles dispersed therein. The mixed dispersion is heated to a temperature close to the glass transition temperature of the resin particles (e.g., 10° C. to 30° C. lower than the glass transition temperature of the resin particles).

For example, the aggregated particle forming step may be performed by adding an aggregating agent to the mixed dispersion at room temperature (e.g., 25° C.) with stirring using a rotary shear homogenizer, adjusting the mixed dispersion to an acidic pH (e.g., a pH of 2 to 5), optionally adding a dispersion stabilizer, and then heating the mixed dispersion.

Examples of the aggregating agent include surfactants having polarity opposite to that of the surfactant contained in the mixed dispersion, inorganic metal salts, and metal complexes with a valence of two or more. In particular, the use of a metal complex as the aggregating agent may reduce the amount of surfactant used, which may improve the charging characteristics.

Together with the aggregating agent, additives that form a complex or a similar linkage together with metal ions of the aggregating agent may optionally be used. Examples of such additives include chelating agents.

Examples of inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of the chelating agent include oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The amount of aggregating agent added is preferably 0.01 parts by mass or more and 5.0 parts by mass or less, more preferably 0.1 parts by mass or more and less than 3.0 parts by mass, based on 100 parts by mass of the resin particles.

Fusion and Coalescence Step

Next, the aggregated-particle dispersion in which the aggregated particles are dispersed is heated, for example, at or above the glass transition temperature of the resin particles (e.g., 30° C. to 50° C. higher than the glass transition temperature of the resin particles) and at or above the melting temperature of the release agent to fuse and coalesce the aggregated particles, thereby forming toner particles.

In the fusion and coalescence step, the resin and the release agent are in a molten state at or above the glass transition temperature of the resin particles and at or above the melting temperature of the release agent. Thereafter, cooling is performed to obtain a toner.

The aspect ratio of domains formed of the release agent in the toner can be controlled, for example, by maintaining the temperature, during cooling, at around the freezing point of the release agent for a given period of time to grow crystals or by using two or more release agents having different melting temperatures to facilitate the crystal growth during cooling.

Through the above steps, toner particles are obtained.

The toner particles may also be produced through a step of, after preparing the aggregated-particle dispersion in which the aggregated particles are dispersed, further mixing the aggregated-particle dispersion with a resin-particle dispersion in which resin particles are dispersed and aggregating the resin particles such that the release agent particles and the resin particles adhere to the surface of the aggregated particles to form second aggregated particles; and a step of fusing and coalescing the second aggregated particles by heating the second aggregated-particle dispersion in which the second aggregated particles are dispersed to form toner particles having a core-shell structure.

After the completion of the fusion and coalescence step, the toner particles formed in the solution are subjected to known washing, solid-liquid separation, and drying steps to obtain dry toner particles. The washing step may be performed by sufficient displacement washing with ion-exchange water from the viewpoint of charging characteristics. The solid-liquid separation step may be performed, for example, by suction filtration or pressure filtration from the viewpoint of productivity. The drying step may be performed, for example, by freeze drying, flash drying, fluidized bed drying, or vibrating fluidized bed drying from the viewpoint of productivity.

The toner according to the exemplary embodiment is produced, for example, by adding an external additive to the dry toner particles obtained and mixing them together. The mixing may be performed, for example, with a V-blender, a Henschel mixer, or a Loedige mixer. Optionally, coarse toner particles may be removed using, for example, a vibrating screen or an air screen.

Electrostatic Image Developer

An electrostatic image developer according to an exemplary embodiment at least includes the toner according to the exemplary embodiment. The electrostatic image developer according to the exemplary embodiment may be a one-component developer including the toner according to the exemplary embodiment alone or a two-component developer including a mixture of the toner and a carrier.

The carrier may be any known carrier. Examples of the carrier include a coated carrier obtained by coating the surface of a core formed of a magnetic powder with a resin; a magnetic-powder-dispersed carrier obtained by dispersing and blending a magnetic powder in a matrix resin; and a resin-impregnated carrier obtained by impregnating a porous magnetic powder with a resin. The magnetic-powder-dispersed carrier and the resin-impregnated carrier may each be a carrier obtained by using the constituent particles of the carrier as cores and coating the surface of the cores with a resin.

Examples of the magnetic powder include magnetic metals such as iron, nickel, and cobalt and magnetic oxides such as ferrite and magnetite.

Examples of the resin for coating and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing organosiloxane bonds and modified products thereof, fluorocarbon resins, polyesters, polycarbonates, phenolic resins, and epoxy resins. The resin for coating and the matrix resin may contain additives such as conductive particles. Examples of the conductive particles include particles of metals such as gold, silver, and copper, carbon black, titanium oxide, zinc oxide, tin oxide, barium sulfate, aluminum borate, and potassium titanate.

From the viewpoint of fine-line reproducibility, the carrier may include a coating resin layer. The coating resin layer more preferably includes an acrylic resin, and particularly preferably includes an acrylic resin having an aliphatic ring.

The aliphatic ring is preferably an aliphatic hydrocarbon ring, more preferably a 5- to 7-membered aliphatic hydrocarbon ring, particularly preferably a cyclohexane ring.

In particular, the acrylic resin having an aliphatic ring preferably has a constitutional unit derived from cyclohexyl (meth)acrylate from the viewpoint of fine-line reproducibility.

An example method for coating the surface of the core with a resin is coating with a solution for coating layer formation obtained by dissolving the resin for coating and various additives (used as required) in an appropriate solvent. Any solvent may be selected by taking into account factors such as the type of resin used and coating suitability. Specific methods for coating the core with the coating resin include a dipping method in which the core is dipped in the solution for coating layer formation; a spraying method in which the surface of the core is sprayed with the solution for coating layer formation; a fluidized bed method in which the core is suspended in an air stream and sprayed with the solution for coating layer formation; and a kneader-coater method in which the carrier core and the solution for coating layer formation are mixed in a kneader-coater and the solvent then is removed.

The mixing ratio (mass ratio) of the toner to the carrier in the two-component developer is preferably 1:100 to 30:100, more preferably 3:100 to 20:100.

Image Forming Apparatus and Image Forming Method

An image forming apparatus according to an exemplary embodiment and an image forming method according to an exemplary embodiment will be described.

The image forming apparatus according to the exemplary embodiment includes an image carrier; a charging unit that charges a surface of the image carrier; an electrostatic image forming unit that forms an electrostatic image on the charged surface of the image carrier; a developing unit that contains an electrostatic image developer and develops, with the electrostatic image developer, the electrostatic image formed on the surface of the image carrier to form a toner image; a transfer unit that transfers the toner image formed on the surface of the image carrier onto a surface of a recording medium; and a fixing unit that fixes the toner image transferred onto the surface of the recording medium. As the electrostatic image developer, the electrostatic image developer according to the exemplary embodiment is used.

The image forming apparatus according to the exemplary embodiment executes an image forming method (the image forming method according to the exemplary embodiment) including a charging step of charging a surface of an image carrier, an electrostatic image forming step of forming an electrostatic image on the charged surface of the image carrier, a developing step of developing, with the electrostatic image developer according to the exemplary embodiment, the electrostatic image formed on the surface of the image carrier to form a toner image, a transferring step of transferring the toner image formed on the surface of the image carrier onto a surface of a recording medium, and a fixing step of fixing the toner image transferred onto the surface of the recording medium.

The image forming apparatus according to the exemplary embodiment may be a known type of image forming apparatus: for example, a direct-transfer apparatus that transfers a toner image formed on a surface of an image carrier directly to a recording medium; an intermediate-transfer apparatus that first transfers a toner image formed on a surface of an image carrier to a surface of an intermediate transfer body and then transfers the toner image transferred onto the surface of the intermediate transfer body to a surface of a recording medium; an apparatus including a cleaning unit that cleans a surface of an image carrier after the transfer of a toner image and before charging; or an apparatus including an erasing unit that erases charge on a surface of an image carrier by irradiation with erasing light after the transfer of a toner image and before charging.

When the image forming apparatus according to the exemplary embodiment is an intermediate-transfer apparatus, the transfer unit includes, for example, an intermediate transfer body having a surface to which a toner image is transferred, a first transfer unit that transfers a toner image formed on a surface of an image carrier to the surface of the intermediate transfer body, and a second transfer unit that transfers the toner image transferred onto the surface of the intermediate transfer body to a surface of a recording medium.

In the image forming apparatus according to the exemplary embodiment, the section including the developing unit may be, for example, a cartridge structure (process cartridge) attachable to and detachable from the image forming apparatus. For example, a process cartridge including a developing unit containing the electrostatic image developer according to the exemplary embodiment is suitable for use as the process cartridge.

A non-limiting example of the image forming apparatus according to the exemplary embodiment will now be described. In the following description, parts illustrated in the drawings are described, and other parts are not described.

FIG. 1 illustrates a schematic configuration of the image forming apparatus according to the exemplary embodiment.

The image forming apparatus illustrated in FIG. 1 includes first to fourth electrophotographic image forming units 10Y, 10M, 10C, and 10K which respectively output yellow (Y), magenta (M), cyan (C), and black (K) images based on color-separated image data. These image forming units (hereinafter also referred to simply as "units") 10Y, 10M, 10C, and 10K are arranged side by side at predetermined intervals in the horizontal direction. The units 10Y, 10M, 10C, and 10K may be process cartridges attachable to and detachable from the image forming apparatus.

An intermediate transfer belt 20 (an example of the intermediate transfer body) extends above the units 10Y, 10M, 10C, and 10K so as to pass through the units. The intermediate transfer belt 20 is wound around a drive roller 22 and a support roller 24, which are in contact with the inner surface of the intermediate transfer belt 20, and is configured to run in the direction from the first unit 10Y toward the fourth unit 10K. A spring or the like (not shown) applies a force to the support roller 24 in the direction away from the drive roller 22, so that tension is applied to the intermediate transfer belt 20 wound around the rollers 22 and 24. An intermediate transfer belt cleaning device 30 is provided on the image carrier side of the intermediate transfer belt 20 so as to face the drive roller 22.

The units 10Y, 10M, 10C, and 10K respectively include developing devices (examples of the developing unit) 4Y, 4M, 4C, and 4K to which yellow, magenta, cyan, and black toners are respectively supplied from toner cartridges 8Y, 8M, 8C, and 8K.

The first to fourth units 10Y, 10M, 10C, and 10K have the same structure and function. Thus, the first unit 10Y, which is disposed upstream in the running direction of the intermediate transfer belt and forms a yellow image, will be described as a representative.

The first unit 10Y includes a photoreceptor 1Y. The photoreceptor 1Y functions as an image carrier and is surrounded by, in sequence, a charging roller 2Y (an example of the charging unit), an exposure device 3 (an example of the electrostatic image forming unit), a developing device 4Y (an example of the developing unit), a first transfer roller 5Y (an example of the first transfer unit), and a photoreceptor cleaning device 6Y (an example of the image carrier cleaning unit). The charging roller 2Y charges the surface of the photoreceptor 1Y to a predetermined potential. The exposure device 3 exposes the charged surface to a laser beam 3Y based on a color-separated image signal to form an electrostatic image. The developing device 4Y supplies a charged toner to the electrostatic image to develop the electrostatic image. The first transfer roller 5Y transfers the developed toner image onto the intermediate transfer belt 20. The photoreceptor cleaning device 6Y removes the toner remaining on the surface of the photoreceptor 1Y after the first transfer.

The first transfer roller 5Y is disposed inside the intermediate transfer belt 20 so as to face the photoreceptor 1Y. The first transfer rollers 5Y, 5M, 5C, and 5K of the units are each connected to a bias power supply (not shown) that applies a first transfer bias. The value of transfer bias applied from each bias power supply to each first transfer roller is changed by control of a controller (not shown).

The operation of the first unit 10Y to form a yellow image will now be described.

Prior to the operation, the charging roller 2Y charges the surface of the photoreceptor 1Y to a potential of −600 V to −800 V.

The photoreceptor 1Y is formed of a conductive substrate (having a volume resistivity at 20° C. of, for example, $1\times10^{-6}$ Ωcm or less) and a photosensitive layer disposed on the substrate. The photosensitive layer, which normally has high resistivity (resistivity of common resins), has the property of, upon irradiation with a laser beam, changing its resistivity in an area irradiated with the laser beam. The exposure device 3 applies the laser beam 3Y to the charged surface of the photoreceptor 1Y on the basis of yellow image data sent from the controller (not shown). As a result, an electrostatic image with a yellow image pattern is formed on the surface of the photoreceptor 1Y.

The electrostatic image is an image formed on the surface of the photoreceptor 1Y by charging. Specifically, the electrostatic image is what is called a negative latent image formed in the following manner: in the area of the photosensitive layer irradiated with the laser beam 3Y, the resistivity drops, and the charge on the surface of the photoreceptor 1Y dissipates from the area, while the charge remains in the area not irradiated with the laser beam 3Y.

As the photoreceptor 1Y rotates, the electrostatic image formed on the photoreceptor 1Y is brought to a predetermined development position. At the development position, the electrostatic image on the photoreceptor 1Y is developed by the developing device 4Y to form a visible toner image.

The developing device 4Y contains, for example, an electrostatic image developer containing at least a yellow toner and a carrier. The yellow toner is frictionally charged as it is stirred inside the developing device 4Y, and thus has a charge with the same polarity (negative) as that of the charge on the photoreceptor 1Y and is held on a developer roller (an example of the developer holding body). As the surface of the photoreceptor 1Y passes through the developing device 4Y, the yellow toner is electrostatically attached to the neutralized latent image portion on the surface of the photoreceptor 1Y to develop the latent image. The photoreceptor 1Y on which the yellow toner image is formed continues to rotate at a predetermined speed to transport the toner image developed on the photoreceptor 1Y to a predetermined first transfer position.

When the yellow toner image on the photoreceptor 1Y is transported to the first transfer position, a first transfer bias is applied to the first transfer roller 5Y, and electrostatic force directed from the photoreceptor 1Y toward the first transfer roller 5Y acts on the toner image to transfer the toner image on the photoreceptor 1Y to the intermediate transfer belt 20. The transfer bias applied has the opposite polarity (positive) to the toner (negative). In the first unit 10Y, the transfer bias is controlled to, for example, +10 μA by the controller (not shown). The toner remaining on the photoreceptor 1Y is removed and collected by the photoreceptor cleaning device 6Y.

The first transfer biases applied to the first transfer rollers 5M, 5C, and 5K of the second to fourth units 10M, 10C, and 10K are controlled in the same manner as in the first unit.

Thus, the intermediate transfer belt 20 to which the yellow toner image is transferred by the first unit 10Y is sequentially transported through the second to fourth units 10M, 10C, and 10K, and as a result, toner images of the respective colors are transferred in a superimposed manner.

The intermediate transfer belt 20, to which the toner images of the four colors are transferred in a superimposed manner through the first to fourth units, runs to a second transfer section including the intermediate transfer belt 20, the support roller 24 in contact with the inner surface of the intermediate transfer belt, and a second transfer roller 26 (an example of the second transfer unit) disposed on the image carrier side of the intermediate transfer belt 20. A sheet of recording paper P (an example of the recording medium) is fed into the nip between the second transfer roller 26 and the intermediate transfer belt 20 at a predetermined timing by a feed mechanism, and a second transfer bias is applied to the support roller 24. The transfer bias applied has the same polarity (negative) as the toner (negative), and electrostatic force directed from the intermediate transfer belt 20 toward the recording paper P acts on the toner image to transfer the toner image on the intermediate transfer belt 20 to the recording paper P. The second transfer bias is determined depending on the resistance detected by a resistance detector (not shown) that detects the resistance of the second transfer section, and thus the voltage is controlled.

The recording paper P to which the toner image is transferred is sent to a pressure-contact part (nip part) between a pair of fixing rollers of a fixing device 28 (an example of the fixing unit), and the toner image is fixed to the recording paper P, thus forming a fixed image. The recording paper P after completion of the fixing of the color image is conveyed to a discharge unit. Thus, the color image forming operation is complete.

Examples of the recording paper P to which the toner image is transferred include plain paper for use in electrophotographic duplicators, printers, and other devices. Examples of recording media other than the recording paper P include OHP sheets. To further improve the surface smoothness of the fixed image, the surface of the recording paper P may also be smooth. For example, coated paper, i.e., plain paper coated with resin or the like and art paper for printing are suitable for use.

Process Cartridge and Toner Cartridge

A process cartridge according to an exemplary embodiment includes a developing unit that contains the electrostatic image developer according to the exemplary embodiment and that develops, with the electrostatic image developer, an electrostatic image formed on a surface of an image carrier to form a toner image. The process cartridge is attachable to and detachable from an image forming apparatus.

The process cartridge according to the exemplary embodiment may include the developing unit and optionally at least one selected from other units such as an image carrier, a charging unit, an electrostatic image forming unit, and a transfer unit.

A non-limiting example of the process cartridge according to the exemplary embodiment will now be described. In the following description, parts illustrated in the drawings are described, and other parts are not described.

Figure 2:
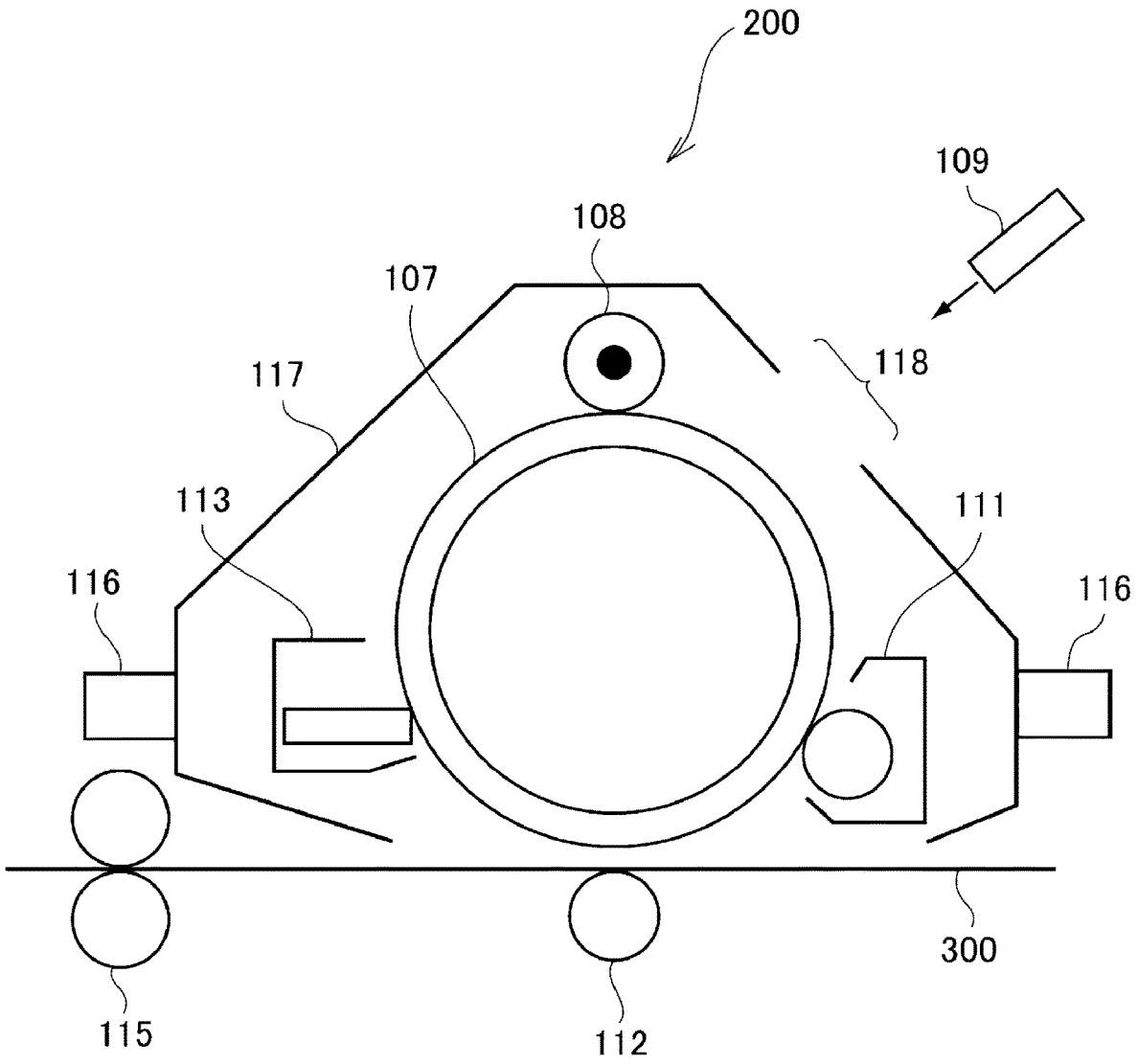
FIG. 2 illustrates a schematic configuration of a process cartridge according to an exemplary embodiment.

FIG. 2 illustrates a schematic configuration of an example of the process cartridge according to the exemplary embodiment.

A process cartridge 200 illustrated in FIG. 2 includes, for example, a photoreceptor 107 (an example of the image carrier), a charging roller 108 (an example of the charging unit) disposed on the periphery of the photoreceptor 107, a developing device 111 (an example of the developing unit), and a photoreceptor cleaning device 113 (an example of the cleaning unit). These units are combined and held together into a cartridge with a housing 117 having mounting rails 116 and an opening 118 for exposure.

In FIG. 2, 109 represents an exposure device (an example of the electrostatic image forming unit), 112 represents a transfer device (an example of the transfer unit), 115 represents a fixing device (an example of the fixing unit), and 300 represents a sheet of recording paper (an example of the recording medium).

Next, a toner cartridge according to an exemplary embodiment will be described.

The toner cartridge according to the exemplary embodiment contains the toner according to the exemplary embodiment and is attachable to and detachable from an image forming apparatus. The toner cartridge contains replenishment toner to be supplied to a developing unit provided in the image forming apparatus.

The image forming apparatus illustrated in FIG. 1 is configured such that the toner cartridges 8Y, 8M, 8C, and 8K are attachable thereto and detachable therefrom. The developing devices 4Y, 4M, 4C, and 4K are connected to the toner cartridges corresponding to the colors of the developing devices through toner supply tubes (not shown). The toner cartridges are replaced when the amount of toner therein is decreased.

EXAMPLES

Examples of the present disclosure will now be described, but the present disclosure is not limited to the following examples. In the following description, all parts and percentages are by mass unless otherwise specified.

In Examples, the number of peaks of an external additive B on an external additive A, the peaks having a height from the surface of the toner particles of 80 nm or more and 250 nm or less; the number average particle size of the secondary particles of the external additive B; and the number average particle size of the external additive A are measured by the above-described methods.

Production of Toner Particles (1)

Preparation of Polyester-Resin-Particle Dispersion (1)

- Ethylene glycol (manufactured by Wako Pure Chemical Industries, Ltd.): 37 parts
- Neopentyl glycol (manufactured by Wako Pure Chemical Industries, Ltd.): 65 parts
- 1,9-Nonanediol (manufactured by Wako Pure Chemical Industries, Ltd.): 32 parts
- Terephthalic acid (manufactured by Wako Pure Chemical Industries, Ltd.): 96 parts The above materials are charged into a flask and heated to 200° C. over 1 hour. After the reaction system is mixed well, 1.2 parts of dibutyltin oxide are put therein. While distilling off produced water, the temperature is increased from 200° C. to 240° C. over 6 hours, and a dehydration condensation reaction is continued at 240° C. for 4 hours, whereby a polyester resin (1) having an acid value of 9.4 mgKOH/g, a weight average molecular weight of 13,000, and a glass transition temperature of 62° C. is obtained.

The polyester resin (1) is transferred into a CAVITRON CD1010 (manufactured by EUROTEC) at a rate of 100 parts per minute while being kept in a molten state. Together with the polyester resin (1), a 0.37% dilute aqueous ammonia separately provided is transferred into the CAVITRON CD1010 at a rate of 0.1 liters per minute while being heated to 120° C. with a heat exchanger. The CAVITRON CD1010 is operated at a rotor rotation speed of 60 Hz and a pressure of 5 kg/cm$^2$ to obtain a polyester-resin-particle dispersion (1) having a solids content of 30 mass %. The volume average particle size of the resin particles included in the polyester-resin-particle dispersion (1) is 160 nm.

Preparation of Colorant-Particle Dispersion (1)

- Cyan pigment (copper phthalocyanine, C.I. Pigment blue 15:3, manufactured by Dainichiseika Color & Chemicals Mfg. Co., Ltd.): 10 parts
- Anionic surfactant (NEOGEN SC, manufactured by DSK Co., Ltd.): 2 parts
- Ion-exchange water: 80 parts The above materials are mixed together. The resulting mixture is subjected to a dispersion treatment for 1 hour using a high-pressure impact disperser ULTIMAIZER (HJP30006, manufactured by Sugino Machine Limited) to obtain a colorant-particle dispersion (1) having a solids content of 20 mass %. The volume average particle size of the colorant particles included in the colorant-particle dispersion (1) is 180 nm.

Preparation of Release-Agent-Particle Dispersion (1)

- Carnauba wax (RC-160, melt temperature: 84° C., manufactured by TOA KASEI CO., LTD.): 50 parts
- Anionic surfactant (NEOGEN SC, manufactured by DSK Co., Ltd.): 2 parts
- Ion-exchange water: 200 parts The above materials are heated to 120° C., subjected to a dispersion treatment using an ULTRA-TURRAX T50 manufactured by IKA, and then subjected to a dispersion treatment using a pressure discharge GAULIN homogenizer to obtain a release-agent-particle dispersion (1) having a solids content of 20 mass %. The volume average particle size of the release agent particles included in the release-agent-particle dispersion (1) is 200 nm.

Production of Toner Particles (1)

- Polyester-resin-particle dispersion (1): 200 parts
- Colorant-particle dispersion (1): 25 parts
- Release-agent-particle dispersion (1): 30 parts
- Polyaluminum chloride: 0.4 parts
- Ion-exchange water: 100 parts The above materials are put into a stainless-steel flask, subjected to a dispersion treatment using an ULTRA-TURRAX manufactured by IKA, and heated to 48° C. while the stainless-steel flask is stirred in an oil bath for heating. After the flask has been held at 48° C. for 30 minutes, 70 parts of the polyester-resin-particle dispersion (1) are added.

Subsequently, after the pH in the system is adjusted to 8.0 using an aqueous sodium hydroxide solution with a concentration of 0.5 mol/L, the stainless-steel flask is hermetically sealed, heated to 90° C. while being kept stirred with a seal of a stirrer shaft being magnetically sealed, and held for 3 hours. Subsequently, cooling is performed at a cooling rate of 2° C./min. After filtration and washing with ion-exchange water are performed, solid-liquid separation is performed by Nutsche suction filtration. The resulting solids are redispersed in ion-exchange water at 30° C. and stirred at a rotation speed of 300 rpm (revolutions per minute) for 15 minutes for washing. This washing operation is further repeated six times. When the pH of the filtrate reaches 7.54 and the electrical conductivity of the filtrate reaches 6.5 μS/cm, solid-liquid separation is performed by Nutsche suction filtration using a filter paper. The resulting solids are vacuum-dried to obtain toner particles (1). The volume average particle size of the toner particles (1) is 5.8 μm.

Production of Toner Particles (2)

Preparation of Core-Forming Resin-Fine-Particle Dispersion A

- Styrene: 335 parts by mass
- n-Butyl acrylate: 65 parts by mass
- Acrylic acid: 6 parts by mass
- Dodecanethiol: 8 parts by mass The above components are mixed and dissolved together to prepare a solution.

The solution is added to another solution of 10 parts of an anionic surfactant (DOWFAX 2A1, manufactured by Dow Chemical Company) in 250 parts of ion-exchange water, and the resulting solution is dispersed and emulsified in a flask (monomer emulsified liquid A).

Furthermore, another solution of 1 part of an anionic surfactant (DOWFAX 2A1, manufactured by Dow Chemical Company) in 555 parts of ion-exchange water is charged into a polymerization flask.

The polymerization flask is provided with a reflux tube. Under a stream of nitrogen, the polymerization flask is heated to 75° C. in a water bath with slow stirring and held there.

After a solution of 9 parts of ammonium persulfate in 43 parts of ion-exchange water is added dropwise to the polymerization flask through a metering pump over 20 minutes, the monomer emulsified liquid A is added dropwise thereto through the metering pump over 200 minutes.

Thereafter, the polymerization flask is held at 75° C. for 3 hours while stirring is continued, and the first-stage polymerization is terminated. Through this process, a core-forming resin-particle dispersion (A) precursor having a volume average particle size of 190 nm, a glass transition temperature of 53° C., and a weight average molecular weight of 33,000 is obtained.

Next, after the temperature is decreased to room temperature, 600 parts of 2-ethylhexyl acrylate and 850 parts of ion-exchange water are added to the polymerization flask and slowly stirred for 2 hours. Thereafter, the temperature is increased to 70° C. while stirring is continued, and 4.5 parts of ammonium persulfate and 110 parts of ion-exchange water are added dropwise thereto through a metering pump over 20 minutes. Thereafter, the resulting mixture is held for 3 hours while stirring is continued, and the polymerization is terminated. Through the above process, a core-forming resin-particle dispersion (A) having a volume average particle size of 260 nm, a weight average molecular weight of 200,000, and a solids content of 33% is obtained.

Preparation of Shell-Forming Resin-Particle Dispersion

Preparation of Shell-Forming Resin-Particle Dispersion (B)

Styrene: 450 parts
N-Butyl acrylate: 135 parts
Allyl methacrylate: 18 parts
Acrylic acid: 12 parts
Dodecanethiol: 9 parts The above components are mixed and dissolved together to prepare a solution.

The solution is added to another solution of 10 parts of an anionic surfactant (DOWFAX 2A1, manufactured by Dow Chemical Company) in 250 parts of ion-exchange water, and the resulting solution is dispersed and emulsified in a flask (monomer emulsified liquid A).

Furthermore, another solution of 1 part of an anionic surfactant (DOWFAX 2A1, manufactured by Dow Chemical Company) in 555 parts of ion-exchange water is charged into a polymerization flask.

The polymerization flask is provided with a reflux tube. Under a stream of nitrogen, the polymerization flask is heated to 75° C. in a water bath with slow stirring and held there.

After a solution of 9 parts of ammonium persulfate in 43 parts of ion-exchange water is added dropwise to the polymerization flask through a metering pump over 20 minutes, the monomer emulsified liquid A is added dropwise thereto through the metering pump over 200 minutes.

Thereafter, the polymerization flask is held at 75° C. for 3 hours while stirring is continued, and the first-stage polymerization is terminated. Through this process, a shell-forming resin-particle dispersion (B) having a volume average particle size of 190 nm, a glass transition temperature of 53° C., a weight average molecular weight of 33,000, and a solids content of 42% is obtained.

Preparation of Colorant-Particle Dispersion

Cyan pigment (Pigment Blue 15:3 (copper phthalocyanine), manufactured by Dainichiseika Color & Chemicals Mfg. Co., Ltd.): 1,000 parts
Anionic surfactant (NEOGEN R, manufactured by DSK Co., Ltd.): 15 parts
Ion-exchange water: 9,000 parts The above components are mixed together and dispersed for 1 hour using a high-pressure impact disperser ULTIMAIZER (HJP30006, manufactured by Sugino Machine Limited) to prepare a colorant-particle dispersion in which a colorant (cyan pigment) is dispersed. The volume average particle size of the colorant (cyan pigment) in the colorant-particle dispersion is 160 nm, and the solids concentration of the colorant-particle dispersion is 20%.

Preparation of Release-Agent-Particle Dispersion

Polyethylene wax (PW725, manufactured by TOYO ADL CORPORATION, melting temperature: 100° C.): 50 parts
Anionic surfactant (NEOGEN RK, manufactured by DSK Co., Ltd.): 0.5 parts
Ion-exchange water: 200 parts The above components are mixed together, heated to 95° C., and dispersed using a homogenizer (ULTRA-TURRAX T50, manufactured by IKA). Thereafter, a dispersion treatment is performed with a MANTON-GAULIN high-pressure homogenizer (manufactured by Gaulin Corporation) to prepare a release-agent-particle dispersion (solids concentration: 20%) in which a release agent is dispersed. The volume average particle size of the release agent is 230 nm.

Production of Toner Particles (2)

Core-forming resin-particle dispersion (A): 504 parts
Colorant-particle dispersion: 63 parts
Ion-exchange water: 710 parts
Anionic surfactant (DOWFAX 2A1, manufactured by Dow Chemical Company): 1 part
Oxidation polymerizable compound (linseed oil): 25 parts The above components serving as materials for core formation are put in a 3-liter reaction vessel equipped with a thermometer, a pH meter, and a stirrer, and 1.0% nitric acid is added thereto at 25° C. to adjust the pH to 3.0. Thereafter, while the resulting mixture is dispersed with a homogenizer (ULTRA-TURRAX T50, manufactured by IKA Japan) at 5,000 rpm, 23 parts of a prepared aqueous aluminum sulfate solution is added and dispersed for 6 minutes.

Thereafter, the reaction vessel is provided with a stirrer and a mantle heater. While the number of rotations of the stirrer is controlled so that the slurry is sufficiently stirred, the temperature is raised at a rate of 0.2° C./min until 40° C. is reached and then at a rate of 0.05° C./min after 40° C. is reached. During this process, the particle size is measured using a MULTISIZER II (aperture size: 50 μm, manufactured by Coulter, Inc.) every 10 minutes. The temperature is maintained when a volume average particle size of 5.0 μm is reached, and 170 parts of a shell-forming resin-particle dispersion (B) serving as a material for shell formation are put in the reaction vessel over 5 minutes. After the resulting mixture is held for 30 minutes, its pH is adjusted to 9.0 by using a 1% aqueous sodium hydroxide solution. Thereafter, while the pH is adjusted to 9.0 in the same manner every 5° C., the temperature is raised to 90° C. at a rate of 1° C./min and held at 98° C. The particle shape and the surface properties are observed under a light microscope and a field-emission scanning electron microscope (FE-SEM). After 10.0 hours, coalescence of the particles is observed, and thus the vessel is cooled to 30° C. with cooling water over 5 minutes.

The cooled slurry is passed through a nylon mesh with 15 μm openings to remove coarse particles, and a toner slurry that has passed through the mesh is filtered under reduced pressure using an aspirator. The toner residue on the filter paper is crushed by hand as finely as possible, and at 30° C., the crushed toner is put in ion-exchange water in an amount 10 times the amount of the toner and mixed with stirring for 30 minutes. Subsequently, the mixture is filtered under reduced pressure using an aspirator. The toner residue on the filter paper is crushed by hand as finely as possible, and at 30° C., the crushed toner is put in ion-exchange water in an amount 10 times the amount of the toner and mixed with stirring for 30 minutes, after which the mixture is filtered again under reduced pressure using an aspirator, and the electrical conductivity of the filtrate is measured. This procedure is repeated until the electrical conductivity of the filtrate reaches 10 μS/cm or less, and the toner is washed. The washed toner is finely crushed in a wet/dry granulator (Comil) and then vacuum-dried in an oven at 35° C. for 36 hours to obtain toner particles. The toner particles obtained have a volume average particle size of 5.8 μm.

Production of Sol-Gel Silica Particles ZG1

Step of Forming Silica Particles

In a glass reaction vessel equipped with a stirrer, a dropping nozzle, and a thermometer, 320 parts of methanol and 72 parts of 10% aqueous ammonia are placed and mixed together to obtain an alkaline catalyst solution. After the temperature of the alkaline catalyst solution is adjusted to 30° C., 50 parts of tetramethoxysilane (TMOS) and 15 parts of 10% aqueous ammonia are added dropwise while the alkaline catalyst solution is stirred, whereby a silica-particle dispersion is obtained. The addition of the TMOS and the addition of the 10% aqueous ammonia are started at the same time. It takes 6 minutes to add the whole amounts of the TMOS and the 10% aqueous ammonia. Next, the silica-particle dispersion is concentrated to a solids concentration of 40 mass % by using a rotary filter (R-fine manufactured by Kotobuki Industrial Co., Ltd.). The concentrated silica-particle dispersion is used as a silica-particle dispersion Step of Surface Treating Silica Particles To 250 parts of the silica-particle dispersion (1), 100 parts of hexamethyldisilazane (HMDS) serving as a hydrophobizing agent are added, and the resulting mixture is heated to 130° C. and allowed to react for 2 hours, after which the reaction product is dried at 150° C. for 2 minutes to obtain hydrophobic silica particles (1). Next, tetrakis(trimethylsiloxy)silane is provided in an amount of 0.002 mass % based on the amount of the hydrophobic silica-particle dispersion (1) and 5-fold diluted with methanol, and the diluted solution is then added to the hydrophobic silica particle (1). Drying is performed while the reaction system is stirred at 80° C. to obtain sol-gel silica particles ZG1. The number average particle size of the sol-gel silica particles ZG1 is 85 nm.

Production of Sol-Gel Silica Particles ZG2

Sol-gel silica particles ZG2 are obtained in the same manner as the production of the sol-gel silica particles ZG1 except that the conditions for the surface treatment of silica particles are changed as shown in Table 2.

Production of Sol-Gel Silica Particles ZG3

Sol-gel silica particles ZG3 are obtained in the same manner as the production of the sol-gel silica particles ZG1 except that the conditions for the formation of silica particles are changed as shown in Table 2.

Production of Sol-Gel Silica Particles ZG4

Sol-gel silica particles ZG4 are obtained in the same manner as the production of the sol-gel silica particles ZG1 except that the conditions for the formation of silica particles are changed as shown in Table 2.

Production of Sol-Gel Silica Particles ZG5

Sol-gel silica particles ZG5 are obtained in the same manner as the production of the sol-gel silica particles ZG1 except that the conditions for the formation and surface treatment of silica particles are changed as shown in Table 2.

Production of Gas-Phase Silica Particles K1

$SiCl_4$, hydrogen gas, and oxygen gas are mixed together in a mixing chamber of a burner and then burnt at a temperature of 1,000° C. to 3,000° C. A silica powder is collected from the burnt gas to obtain a silica base material. At this time, the molar ratio of the hydrogen gas to the oxygen gas is set to $H_2:O_2=1.1:1$, whereby silica particles (1) having a number average particle size of 89 nm are obtained.

Into an evaporator, 100 parts of the silica particles (1) and 550 parts of ethanol are placed, and the resulting mixture is stirred for 15 minutes while the temperature is maintained at 40° C. Next, a dimethyl silicone oil S-1 (KF96-100cs, manufactured by Shin-Etsu Chemical Co., Ltd.) in an amount of 5 parts based on 100 parts of the silica particles (1) is added and stirred for 15 minutes, and then a dimethyl silicone oil in an amount of 5 parts based on 100 parts of the silica particles (1) is further added and stirred for 15 minutes. Lastly, the temperature is increased to 90° C., and the ethanol is dried off under reduced pressure. Thereafter, the treated product is removed from the evaporator and further vacuum-dried at 120° C. for 30 minutes to thereby obtain gas-phase silica particles K1 having a number average particle size of 89 nm and an oil content of 3.4%.

Production of Gas-Phase Silica Particles K2

Gas-phase silica particles K2 are obtained in the same manner as the production of the gas-phase silica particles K1 except that the oil used in the step of surface treatment of silica particles is changed to a dimethyl silicone oil S-2 (KF96-10cs, manufactured by Shin-Etsu Chemical Co., Ltd.).

Production of Gas-Phase Silica Particles K3

Gas-phase silica particles K3 are obtained in the same manner as the production of the gas-phase silica particles K1 except that the oil used in the step of surface treatment of silica particles is changed to a dimethyl silicone oil S-3 (KF96-1000cs, manufactured by Shin-Etsu Chemical Co., Ltd.).

Production of Gas-Phase Silica Particles K4

Gas-phase silica particles K4 are obtained in the same manner as the production of the gas-phase silica particles K1 except that the molar ratio of hydrogen gas to oxygen gas and the surface treatment conditions are changed as shown in Table 3.

Production of Ferrite Particles $Fe_2O_3$ (2,000 parts), $MnO_2$ (800 parts), $Mg(OH)_2$ (200 parts), and $SrCO_3$ (20 parts) are mixed together and pulverized in a wet ball mill for 10 hours. Next, granulation and drying are performed with a spray dryer, and then calcination 1 is performed at 900° C. for 7 hours using a rotary kiln. The calcined product 1 thus obtained is pulverized in a wet ball mill for 2 hours to an average particle size of 2 μm, and then granulation and drying are further performed with a spray dryer, after which calcination 2 is performed at 1000°

C. for 6 hours using a rotary kiln. The calcined product 2 thus obtained is pulverized in a wet ball mill for 5 hours to an average particle size of 5 μm, and then granulation and drying are further performed with a spray dryer, after which firing is performed at 1,300° C. for 5 hours with an electric furnace. The fired product is disintegrated and classified to prepare ferrite particles having an average particle size of 35 μm.

Preparation of Coating Liquid 1

Cyclohexyl methacrylate resin (weight average molecular weight: 50,000): 39 parts by mass Carbon black (VXC72, manufactured by Cabot Corporation): 4 parts by mass Toluene: 250 parts by mass Isopropyl alcohol: 50 parts by mass The above components and glass beads (particle size: 1 mm, in an amount equal to the amount of toluene) are put into a sand mill manufactured by Kansai Paint Co., Ltd. and stirred at a rotation speed of 1,200 rpm for 30 minutes to prepare a coating liquid 1 having a solids content of 13%.

Preparation of Coating Liquid 2

A coating liquid 2 is prepared in the same manner as the coating liquid 1 except that the cyclohexyl methacrylate is replaced with a cyclopentyl acrylate resin (weight average molecular weight: 40,000).

Preparation of Coating Liquid 3

A coating liquid 3 is prepared in the same manner as the coating liquid 1 except that the cyclohexyl methacrylate is replaced with a methyl methacrylate resin (weight average molecular weight: 50,000).

Production of Carrier 1

In a vacuum degassing kneader, 2,000 parts of the ferrite particles and 500 g of the coating liquid 1 are placed and mixed together with stirring at 60° C. for 15 minutes under a reduced pressure of (atmospheric pressure—200 mmHg). Thereafter, the temperature is increased, and the pressure is reduced. Drying with stirring is performed at 94° C. and a pressure of (atmospheric pressure—720 mmHg) for 30 minutes to obtain coated particles. The coated particles are then sifted through a 75-μm mesh sieve to obtain a carrier 1 having a volume average particle size of 36 μm.

Production of Carrier 2

A carrier 2 having a volume average particle size of 36 μm is obtained in the same manner as the carrier 1 except that the coating liquid 1 is replaced with the coating liquid 2.

Production of Carrier 3

A carrier 3 having a volume average particle size of 36 μm is obtained in the same manner as the carrier 1 except that the coating liquid 1 is replaced with the coating liquid 3.

Example 1

The toner particles (1), the sol-gel silica particles ZG1, and the gas-phase silica particles K1 are placed in a Henschel mixer at a ratio of toner particles:sol-gel silica particles:gas-phase silica particles=98:1:1 (by mass) and stirred at a stirring peripheral speed of 30 m/sec for 15 minutes to obtain an externally added toner.

The externally added toner and the carrier are placed in a V blender at a ratio of externally added toner:carrier=10:90 (by mass) and stirred for 20 minutes to obtain a developer.

Examples 2 to 10 and Comparative Examples 1 and 2

For Examples 2 to 10 and Comparative Examples 1 and 2, toners of Examples 2 to 10 and Comparative Examples 1 and 2 are produced in the same manner as in Example 1 except that resin-particle dispersions and release-agent-particle dispersions shown in Table 1 are used. For each toner, an electrostatic image developer is obtained in the same manner as in Example 1 except that an external additive shown in Table 1 is used.

Evaluation of Fine-Line Reproducibility

A "700 Digital Color Press" manufactured by Fuji Xerox Co., Ltd. is provided. The black developer and the yellow developer obtained in each of Examples and Comparative Examples are charged into a developing device of the 700 Digital Color Press and left to stand in an environment at 28° C. and 98% RH for 12 hours, and a 1%-printed chart is then printed on 100,000 A4 sheets in the environment. After the initial (10th) printing, the 1,000th printing, the 10,000th printing, the 50,000th printing, and the 100,000th printing, and after 72 hours from the 100,000th printing, a 1-on 1-off image (an image in which 1-dot lines are arranged in parallel at 1-dot intervals) with a resolution of 2,400 dpi is printed, as a 5 cm×5 cm chart vertical to the developing direction, at the upper left, the center, and the lower right of a A4 sheet. For each of the charts printed on the output samples, the line spacing is observed using a ×100 measuring magnifier to see whether there is an area where the spacing is narrow due to, for example, toner scattering or an area where the spacing is broad due to thin fine lines. On the basis of the observations and the line spacing at the observed areas, grade evaluation is performed according to the following criteria.

G1: In all the charts, neither a decrease in line spacing due to scattering nor an increase in line spacing due to fine-line thinning is observed.

G2: A decrease or an increase in line spacing is observed, but fine lines are observable in at least one chart.

G3: The spacing between fine lines is indistinguishable, or deletion of fine lines is observed in at least one chart.

G4: The spacing between fine lines is indistinguishable, or deletion of fine lines is observed in two or more charts.

The evaluation results are collectively shown in Table 1.

TABLE 1

| | External additive A | | | | External additive B | | | | | | | | |
|---|---|---|---|---|---|---|---|---|---|---|---|---|---|
| | Type | Number average particle size (nm) | Addition amount (parts by mass) | Content of siloxane compound (ppm) | Type | Number average particle size of secondary particles (nm) | Addition amount (parts by mass) | Proportion of aggregated particles (number %) | Type of carrier | Number of peaks | $P^B/P^A$ | Binder resin in toner particles | Fine-line reproducibility |
| Example 1 | ZG1 | 85 | 2.5 | 35 | K1 | 160 | 1.5 | 90 | 1 | 42 | 1.9 | polyester resin | G1 |
| Example 2 | ZG1 | 85 | 3.0 | 35 | K2 | 150 | 1.5 | 85 | 1 | 28 | 1.8 | polyester resin | G2 |
| Example 3 | ZG1 | 85 | 3.0 | 35 | K3 | 180 | 1.2 | 95 | 1 | 46 | 2.1 | polyester resin | G1 |

TABLE 1-continued

| | External additive A | | | | External additive B | | | | | | | | |
|---|---|---|---|---|---|---|---|---|---|---|---|---|---|
| | Type | Number average particle size (nm) | Addition amount (parts by mass) | Content of siloxane compound (ppm) | Type | Number average particle size of secondary particles (nm) | Addition amount (parts by mass) | Proportion of aggregated particles (number %) | Type of carrier | Number of peaks | $P^B/P^A$ | Binder resin in toner particles | Fine-line reproducibility |
| Example 4 | ZG1 | 85 | 2.0 | 35 | K4 | 200 | 1.5 | 85 | 1 | 65 | 2.4 | polyester resin | G1 |
| Example 5 | ZG2 | 85 | 2.3 | 0 | K1 | 160 | 1.5 | 85 | 1 | 42 | 1.9 | polyester resin | G1 |
| Example 6 | ZG3 | 120 | 4.5 | 35 | K1 | 160 | 1.2 | 80 | 1 | 15 | 1.3 | polyester resin | G3 |
| Example 7 | ZG4 | 50 | 2.0 | 35 | K1 | 160 | 2.5 | 95 | 1 | 92 | 3.2 | polyester resin | G2 |
| Example 8 | ZG1 | 85 | 3.0 | 35 | K1 | 160 | 1.5 | 90 | 1 | 38 | 1.9 | styrene acrylic resin | G1 |
| Example 9 | ZG1 | 85 | 2.5 | 35 | K1 | 160 | 1.5 | 90 | 2 | 42 | 1.9 | polyester resin | G1 |
| Example 10 | ZG1 | 85 | 2.5 | 35 | K1 | 160 | 1.5 | 90 | 3 | 42 | 1.9 | polyester resin | G1 |
| Comparative Example 1 | ZG5 | 50 | 2.0 | 1,200 | K2 | 150 | 0.5 | 60 | 1 | 0 | 3.0 | polyester resin | G4 |
| Comparative Example 2 | ZG1 | 85 | 3.0 | 35 | K4 | 200 | 2.5 | 100 | 1 | 130 | 2.4 | polyester resin | G4 |

TABLE 2

| | Silica particle formation step | | | | | | Surface treatment step | | | |
|---|---|---|---|---|---|---|---|---|---|---|
| | Alkaline catalyst solution | | Conditions for particle formation | | | | Siloxane compound having molecular weight of 200 or more and 600 or less | | Drying conditions | |
| External additive A | Methanol Parts by mass | 10% aqueous ammonia Parts by mass | TMOS Parts by mass | 10% aqueous ammonia Parts by mass | Drop time min | Hydrophobizing agent | Type | Addition amount mass % | Drying temperature ° C. | Drying time min |
| ZG1 | 320 | 72 | 50 | 15 | 6 | HMDS | tetrakis(trimethylsiloxy)silane | 0.002 | 80 | 15 |
| ZG2 | 320 | 72 | 50 | 15 | 6 | HMDS | — | 0 | — | — |
| ZG3 | 320 | 72 | 185 | 50 | 30 | HMDS | tetrakis(trimethylsiloxy)silane | 0.002 | 80 | 15 |
| ZG4 | 320 | 72 | 45 | 12 | 6 | HMDS | tetrakis(trimethylsiloxy)silane | 0.002 | 80 | 15 |
| ZG5 | 320 | 72 | 45 | 12 | 6 | HMDS | tetrakis(trimethylsiloxy)silane | 0.07 | 80 | 15 |

TABLE 3

| | Particle formation Molar ratio | | Ethanol | | Surface treatment | | | |
|---|---|---|---|---|---|---|---|---|
| | | | | | Amount of first addition | Time of first | Amount of second addition | Time of second |
| External additive B | Hydrogen gas | Oxygen gas | Parts by mass | Oil type | Parts by mass | stirring min | Parts by mass | stirring min |
| K1 | 1.1 | 1 | 550 | S-1 | 5 | 15 | 5 | 15 |
| K2 | 1.1 | 1 | 550 | S-2 | 5 | 15 | 5 | 15 |
| K3 | 1.1 | 1 | 550 | S-3 | 5 | 15 | 5 | 15 |
| K4 | 1.3 | 1 | 550 | S-1 | 5 | 15 | 14 | 60 |

In Table 1, "Number of peaks" means "the number of peaks of an external additive B on an external additive A, the peaks having a height from the surface of toner particles of 80 nm or more and 200 nm or less", and "$P^B/P^A$" means "the ratio of the number average particle size $P^B$ of secondary particles of an external additive B to the number average particle size $P^A$ of an external additive A ($P^B/P^A$)"

The results shown in Table 1 indicate that the electrostatic image developing toners of Examples are superior in fine-line reproducibility to the electrostatic image developing toners of Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic image developing toner comprising:

a toner particle;

an external additive A, and;

an external additive B, wherein at least the external additive A is present on a surface of the toner particle, at least the external additive B is present on the external additive A, and the number of peaks of the external additive B on the external additive A is 5 or more and 100 or less per 30 μm peripheral length of the toner particle, the peaks having a height from the surface of the toner particle of 80 nm or more and 250 nm or less, wherein a ratio of a number average particle size $P^B$ of the secondary particles of the external additive B to a number average particle size $P^A$ of the external additive A ($P^B/P^A$) is 1.3 or more and 20 or less.

2. The electrostatic image developing toner according to claim 1, wherein 80 number % or more of the external additive B is constituted by secondary particles.

3. The electrostatic image developing toner according to claim 2, wherein a ratio of a number average particle size $P^B$ of the secondary particles of the external additive B to a number average particle size $P^A$ of the external additive A ($P^B/P^A$) is 1.3 or more and 10 or less.

4. The electrostatic image developing toner according to claim 1, wherein the external additive A contains a siloxane compound having a molecular weight of 200 or more and 600 or less.

5. The electrostatic image developing toner according to claim 2, wherein the external additive A contains a siloxane compound having a molecular weight of 200 or more and 600 or less.

6. The electrostatic image developing toner according to claim 3, wherein the external additive A contains a siloxane compound having a molecular weight of 200 or more and 600 or less.

7. The electrostatic image developing toner according to claim 4, wherein a content of the siloxane compound is 5 ppm or more and 1,000 ppm or less based on a total mass of the external additive A.

8. The electrostatic image developing toner according to claim 5, wherein a content of the siloxane compound is 5 ppm or more and 1,000 ppm or less based on a total mass of the external additive A.

9. The electrostatic image developing toner according to claim 6, wherein a content of the siloxane compound is 5 ppm or more and 1,000 ppm or less based on a total mass of the external additive A.

10. The electrostatic image developing toner according to claim 1, wherein the external additive A is a wet-process silica particle, and the external additive B is a gas-phase-process silica particle.

11. The electrostatic image developing toner according to claim 2, wherein the external additive A is a wet-process silica particle, and the external additive B is a gas-phase-process silica particle.

12. The electrostatic image developing toner according to claim 1, wherein the number of peaks is 30 or more and 80 or less per 30 μm peripheral length of the toner particle.

13. An electrostatic image developer comprising the electrostatic image developing toner according to claim 1.

14. The electrostatic image developer according to claim 13, further comprising a carrier.

15. The electrostatic image developer according to claim 14, wherein the carrier includes a coating resin layer, and the coating resin layer includes an acrylic resin having an aliphatic ring.

16. The electrostatic image developer according to claim 15, wherein the acrylic resin having an aliphatic ring has a constitutional unit derived from cyclohexyl (meth)acrylate.

17. A toner cartridge attachable to and detachable from an image forming apparatus, the toner cartridge comprising the electrostatic image developing toner according to claim 1.

18. A process cartridge attachable to and detachable from an image forming apparatus, the process cartridge comprising a developing unit that contains the electrostatic image developer according to claim 13 and develops, with the electrostatic image developer, an electrostatic image formed on a surface of an image carrier to form a toner image.

19. An image forming apparatus comprising:

an image carrier;

a charging unit that charges a surface of the image carrier;

an electrostatic image forming unit that forms an electrostatic image on the charged surface of the image carrier;

a developing unit that contains the electrostatic image developer according to claim 13 and develops, with the electrostatic image developer, the electrostatic image formed on the surface of the image carrier to form a toner image;

a transfer unit that transfers the toner image formed on the surface of the image carrier onto a surface of a recording medium; and a fixing unit that fixes the toner image transferred onto the surface of the recording medium.

20. An image forming method comprising:

charging a surface of an image carrier;

forming an electrostatic image on the charged surface of the image carrier;

developing, with the electrostatic image developer according to claim 13, the electrostatic image formed on the surface of the image carrier to form a toner image;

transferring the toner image formed on the surface of the image carrier onto a surface of a recording medium; and fixing the toner image transferred onto the surface of the recording medium.

* * * * *